US005624776A

United States Patent [19]

Takei et al.

[11] Patent Number: 5,624,776

[45] Date of Patent: Apr. 29, 1997

[54] ELECTROPHOTOGRAPHIC PHOTOSENSITIVE MEMBER PROVIDED WITH A LIGHT RECEIVING LAYER COMPOSED OF A NON-SINGLE CRYSTAL SILICON MATERIAL CONTAINING COLUMNAR STRUCTURE REGIONS AND PROCESS FOR THE PRODUCTION THEREOF

[75] Inventors: Tetsuya Takei, Nagahama; Hirokazu Ohtoshi, Nara; Takehito Yoshino, Nara; Ryuji Okamura, Nara; Yasuyoshi Takai, Nara, all of Japan

[73] Assignee: Canon Kabushiki Kaisha, Tokyo, Japan

[21] Appl. No.: 196,111

[22] PCT Filed: Jun. 18, 1993

[86] PCT No.: PCT/JP93/00824

§ 371 Date: Feb. 18, 1994

§ 102(e) Date: Feb. 18, 1994

[87] PCT Pub. No.: WO93/25940

PCT Pub. Date: Dec. 23, 1993

[30] Foreign Application Priority Data

Jun. 18, 1992 [JP] Japan ..... 4-182863

[51] Int. Cl.[6] ..... G03G 15/00

[52] U.S. Cl. ..... 430/56; 430/84; 430/95; 430/128

[58] Field of Search ..... 430/56, 84, 95, 430/128

[56] References Cited

U.S. PATENT DOCUMENTS

| | | | |
|---|---|---|---|
| 4,269,919 | 5/1981 | Kuehnle | 430/84 |
| 4,737,430 | 4/1988 | Kinoshita et al. | 430/59 |
| 4,789,646 | 12/1988 | Davis | 430/84 |
| 5,162,181 | 11/1992 | Fujimoto et al. | 430/58 |
| 5,213,922 | 5/1993 | Matsuo et al. | 430/48 |

FOREIGN PATENT DOCUMENTS

| | | |
|---|---|---|
| 58-7149 | 1/1983 | Japan . |
| 61-179870 | 8/1986 | Japan . |
| 63-73263 | 4/1988 | Japan . |
| 64-62660 | 3/1989 | Japan . |
| 5-53355 | 3/1993 | Japan . |

*Primary Examiner*—George F. Lesmes
*Assistant Examiner*—Laura Weiner
*Attorney, Agent, or Firm*—Fitzpatrick, Cella, Harper & Scinto

[57] ABSTRACT

An electrophotographic photosensitive member comprising a substrate and a light receiving layer composed of a silicon-containing non-single crystal material disposed on said substrate, characterized in that said light receiving layer contains a plurality of columnar structure regions each grown from a nucleus situated in said light receiving layer wherein said plurality of columnar structure regions are arranged substantially in parallel to the thicknesswise direction of said light receiving layer and at a density in the range of $5/cm^2$ to $500/cm^2$.

13 Claims, 15 Drawing Sheets

ELECTROPHOTOGRAPHIC PHOTOSENSITIVE MEMBER PROVIDED WITH A LIGHT RECEIVING LAYER COMPOSED OF A NON-SINGLE CRYSTAL SILICON MATERIAL CONTAINING COLUMNAR STRUCTURE REGIONS AND PROCESS FOR THE PRODUCTION THEREOF

FIELD OF THE INVENTION

The present invention relates to an electrophotographic photosensitive member comprising a substrate and a light receiving layer composed of a non-single crystal silicon material containing a plurality of columnar structure regions therein which is disposed on said substrate, and a process for the production of said electrophotographic photosensitive member.

RELATED BACKGROUND ART

The material of the photoconductive layer of an electrophotographic photosensitive member is required to have a high sensitivity, high S/N ratio, absorption spectral characteristic matching the spectral characteristic of electromagnetic wave to be irradiated, rapid optical responsibility, and high dark resistance, to be excellent in mechanical durability, and to be not harmful to the human body at the time of use.

The public attention has been focused on the use of hydrogenated amorphous silicon materials capable of satisfying the above requirements in electrophotographic photosensitive members. Electrophotographic photosensitive members having a photoconductive layer formed of such hydrogenated amorphous silicon material are disclosed, for example, in Japanese Unexamined Patent Publication No. 86341/1979. Various electrophotographic photosensitive members having an amorphous silicon photoconductive layer have been frequently used.

Japanese Unexamined Patent Publications Nos. 62254/1981 and 119356/1982 disclose the use of hydrogenated amorphous silicon materials containing carbon atoms in electrophotographic photosensitive members in order to improve their electrophotographic characteristics.

Incidentally, the formation of a film of such amorphous silicon material as above described as a constituent of the electrophotographic photosensitive member can be conducted by the sputtering process, film-forming manner by decomposing raw material gas with the action of thermal energy (that is, the so-called thermal-induced CVD process), film-forming manner by decomposing raw material gas with the action of light energy (that is, the so-called light-induced CVD process), or film-forming manner by decomposing raw material gas with the action of plasma (that is, the so-called plasma CVD process). Of these film-forming processes, the plasma CVD process has been frequently used. And there are known various apparatus suitable for practicing the plasma CVD process.

As the plasma CVD process, there is known the so-called microwave plasma CVD process based on microwave glow discharge decomposition. The microwave plasma CVD process has been practiced on an industrial scale.

The microwave plasma CVD process is more advantageous in comparison with other film-forming processes in the viewpoints that a relatively higher deposition rate and a relatively higher raw material gas utilization efficiency are attained. U.S. Pat. No. 4,504,518 discloses a microwave plasma CVD technique of making use of these advantages. The microwave plasma CVD technique described in this patent literature is directed to the formation of a high quality deposited film at a high deposition rate by practicing the microwave plasma CVD process at a reduced pressure of 0.1 Tort or less.

Japanese Unexamined Patent Publication No. 186849/1985 discloses a technique of improving the raw material gas utilization efficiency in the microwave plasma CVD process. The technique described in this publication is to improve the raw material gas utilization efficiency by arranging a substrate to circumscribe means for introducing microwave energy thereby forming an internal chamber (that is, a discharge space). Further, Japanese Unexamined Patent Publication No. 283116/1986 discloses a technique of improving the property of a deposited film formed by conducting the formation of the deposited film while controlling ion bombardment to the film deposited by applying a desired voltage through a plasma potential-controlling electrode (that is, a bias electrode) disposed in the discharge space.

U.S. Pat. No. 5,129,359 discloses a process for producing an electrophotographic photosensitive member based on these microwave plasma CVD techniques.

The process for producing an electrophotographic photosensitive member described in this U.S. Pat. No. 5,129,359 is practiced, for instance, by using a film-forming apparatus shown in FIG. 6(A) as a longitudinal section view and FIG. 6(B) as a cross section view.

In FIGS. 6(A) and 6(B), reference numeral 601 indicates a reaction chamber having a structure capable of being vacuum-sealed. Reference numeral 602 indicates a microwave introducing dielectric window made of a material (for example, quartz glass, alumina ceramics, or the like) which allows a microwave power to efficiently transmit into the reaction chamber 601 and can hermetically enclose the inside of the reaction chamber. Reference numeral 603 indicates a waveguide which serves to transmit a microwave power. The waveguide comprises a rectangular portion extending from a microwave power source (not shown) to the neighborhood of the reaction chamber and a cylindrical portion situated in the reaction chamber.

The waveguide 603 is connected to the microwave power source (not shown) through a stub tuner (not shown) and an isolator (not shown). Reference numeral 604 indicates an exhaust pipe. The exhaust pipe is open into the reaction chamber 601 through one end thereof and is connected to an exhaust device (not shown) through the remaining end thereof. Reference numeral 606 indicates a discharge space circumscribed by a plurality of substrates 605. Reference numeral 611 indicates a D.C. power source (a bias power source) which serves to apply a D.C. voltage to a bias electrode 612.

The process for producing an electrophotographic photosensitive member using the film-forming apparatus of the above-described constitution is conducted, for example, in the following manner. That is, the reaction chamber 601 is evacuated through the exhaust pipe 604 by operating a vacuum pump (not shown) to bring the inside of the reaction chamber 601 to a vacuum of $1\times10^{-7}$ or less. The substrates 605 are then heated to and maintained at a temperature of 200° to 300° C. by means of heaters 607. Thereafter, raw material gases such as silane gas, hydrogen gas, and the like are introduced into the reaction chamber 601 through gas feed means (not shown). Then, a microwave power of 2.45 GHz from the microwave power source is introduced into the reaction chamber 601 through the waveguide 603 and the dielectric window 602. Simultaneously with this, the bias power source 611 electrically connected to the bias electrode 612 positioned in the discharge space 606 is switched on to apply a desired bias voltage between the bias electrode 612 and the substrates 605. In this case, the raw material gases in the discharge space 606 circumscribed by the substrates are excited and decomposed with the action of an energy of the microwave power, wherein ion bombardment is directed onto the substrates 605 by virtue of an electric field generated between the bias electrode 611 and the substrates 605, whereby a deposited film is formed on each of the substrates 605. During this film formation, each of the substrates 605 is rotated by revolving the rotary shaft 609 by means of a motor 610.

According to this process, it is possible to obtain electrophotographic photosensitive members having practically acceptable electrophotographic characteristics and which are satisfactory in terms of uniformity at a relatively low production cost. However, as for the electrophotographic photosensitive members produced by the conventional process, there are still remained problems which are required to be resolved. For instance, upon film formation by the conventional process, in the zone in which film formation is carried out at a relatively higher film-forming speed, it is difficult to stably obtain a deposited film which is homogeneous in terms of film quality, satisfies the requirements for optical and electric characteristics desired therefor, and is free of defects resulting in providing defective images upon image formation by the electrophotographic image forming process, at a high yield.

Specifically, as for the deposited film obtained in this case, it is often accompanied by a defect which leads to occurrence of uneven density for an image reproduced. The occurrence of uneven density for an image reproduced is not so problematic in the case of reproducing an original containing characters only. However, it is apparently problematic in the case of reproducing a halftone original such as a photograph, especially when the reproduction thereof is conducted at a high image-forming process speed. Further in the case of reproduction of a colored image for which demand has increased in recent years, it is required for an image reproduced to be precisely uniform in terms of the image density. In this case, the above occurrence of uneven density is a serious problem.

In addition, the electrophotographic photosensitive member comprising such deposited film does not satisfactorily comply with a demand in recent years for an improvement in the resolution for an image reproduced. The resolution of an image reproduced is governed by not only the electrophotographic photosensitive member but also the electrophotographic image-forming process including development and fixing steps which is employed upon the image formation. In recent years, a fine particle toner has been developed, and the electrophotographic image-forming process has been improved so as to make full advantage of such fine particle toner. Along with this, there is an increased demand for the electrophotographic photosensitive member to be improved so that an improvement is attained for the resolution for an image reproduced. However, making an electrophotographic photosensitive member comprising the above deposited film is difficult, to satisfy this demand.

European Patent Publication No. 454456 A1 proposes a technique of eliminating the above problems. Particularly, this patent publication discloses a light receiving member having a photoconductive layer composed of a non-single crystal silicon carbide containing fluorine atoms in a trace amount of 1 to 95 atomic ppm and oxygen atoms in a controlled amount in which the photoconductive layer is effectively relaxed in terms of internal distortion and is free of spherical growth defects at the surface and which is capable of preventing occurrence of "minute blank area", occurrence of "coarseness" and occurrence of "ghost" on an image reproduced. The technique described in this patent publication is aimed at diminishing the spherical growth defect at the surface of the light receiving layer of the light receiving member so as to stabilize and improve the quality of an image reproduced.

However, it is almost impossible to completely eliminate the appearance of such spherical growth defect at the surface of a photoconductive layer composed of a non-single crystal silicon carbide even by incorporating a prescribed amount of fluorine atoms and oxygen atoms thereinto. In fact, the present inventors prepared a light receiving member of the above constitution and subjected the light receiving member to continuous reproduction of a halftone original at an image-forming speed of 50 sheets per minute over a long period of time. As a result, there were found occurrence of uneven density and occurrence of a reduction in the resolution for the images reproduced after repetition of the copying shots. The causes for these problems are considered due to the spherical growth defect present at the surface of the photoconductive layer.

Japanese Unexamined Patent Publications Nos. 84965/1987 and 188665/1987 disclose a technique of eliminating the problems of an electrophotographic photosensitive member due to unevenness in the thickness thereof by grinding the surface of the electrophotographic photosensitive member. However, these patent publications do not describe anything about the interrelations between the surface grinding and the defects occurred on an image reproduced.

Incidentally, the present inventors found that the surface grinding technique described in these patent publications is not satisfactorily effective in making the electrophotographic photosensitive member such that it stably provides a high quality reproduced image excelling in resolution and density uniformity upon high speed image reproduction.

In order to stably obtain a high quality reproduced image excelling in resolution and density in high speed image reproduction, due care should be made so that no problem is occurred due to reflection of light used for the exposure. For instance, in the case of conducting image reproduction using an amorphous silicon series photosensitive member as the photoreceptor in the digital copying machine in which a semiconductor laser is used as the exposure light source, there is used as the semiconductor laser a near infrared laser having an energy which is lower than the energy band gap of the amorphous silicon film of the photosensitive member, wherein the laser rays are not completely absorbed by the amorphous silicon film and the residual laser rays other than those absorbed by the amorphous silicon film are transmitted or reflected. In this case, the laser rays reflected at the surface of the photosensitive member often interfere with the laser rays reflected at the interface between the amorphous silicon film and the substrate or the layer interface of the amorphous silicon film to provide an interference fringe pattern on an image reproduced.

U.S. Pat. No. 4,808,504 discloses a technique of eliminating the problem of providing such interference fringe pattern on an image reproduced. Particularly, this patent literature describes an electrophotographic photosensitive member comprising a substrate having an uneven-shaped surface composed of a plurality of spherical dimples and a light receiving layer disposed on said uneven-shaped surface of the substrate in which interference fringes occurred are dispersed within the spherical dimples to prevent images reproduced from being accompanied by interference fringe patterns.

This electrophotographic photosensitive member has been evaluated as being effective to prevent the occurrence of an interference fringe pattern on an image reproduced. However, the electrophotographic photosensitive member is disadvantageous in the viewpoint that the production cost thereof unavoidably becomes remarkable because specific facility and process are required for forming the uneven-shaped surface composed of a plurality of spherical dimples at the surface of a substrate in the preparation of the electrophotographic photosensitive member.

SUMMARY OF THE INVENTION

The present invention is aimed at providing an improved electrophotographic photosensitive member which is free of the foregoing problems relating to occurrence of uneven density and reduction in resolution on an image reproduced which are found in the case of the conventional electrophotographic photosensitive member.

Another object of the present invention is to provide an electrophotographic photosensitive member comprising a substrate and a light receiving layer composed of a non-single crystal material containing silicon atoms as a matrix disposed on said substrate, characterized in that said light receiving layer contains a plurality of columnar structure regions each grown based on a nucleus present in said light receiving layer which are spacedly arranged substantially in parallel to the thicknesswise direction of said light receiving layer at a density of $5/cm^2$ to $500/cm^2$.

A further object of the present invention is to a process which enables one to produce the above electrophotographic photosensitive member by the microwave plasma CVD process at a reduced production cost.

In order to solve the foregoing problems in the conventional electrophotographic photosensitive member and to attain the above objects, the present inventors made extensive studies by preparing a number of electrophotographic photosensitive members each having a light receiving layer composed of a non-single crystal silicon material (specifically, an amorphous silicon material) containing a plurality of columnar structure regions intentionally formed therein. As a result, the present inventors obtained the following findings. That is, (1) when the light receiving layer formed on a substrate is comprised of a non-single crystal silicon material containing a plurality of columnar structure regions established substantially in parallel to the thicknesswise direction, the resulting photosensitive member becomes such that no charge flow occurs in the thicknesswise direction of the light receiving layer and because of this, an improvement is attained in terms of the resolution of an image reproduced; and (2) the reflection of incident light at the surface of the photosensitive member, that at the layer interface and that at the surface of the substrate are dispersed to diminish the occurrence of unevenness in terms of light reflection (that is, to diminish a difference in terms of the absorbed amount of light).

The present invention has been accomplished based on these findings. The present invention is of the gist which will be described in the following. That is, the present invention is directed to an improvement in an electrophotographic photosensitive member comprising a substrate and a light receiving layer composed of a non-single crystal material containing silicon atoms as a matrix disposed on said substrate, the improvement is characterized in that said light receiving layer contains a plurality of columnar structure regions each grown based on a nucleus present in said light receiving layer which are arranged substantially in parallel to the thicknesswise direction of said light receiving layer at a density of $5/cm^2$ to $500/cm^2$.

The present invention includes a process for producing the above electrophotographic photosensitive member. Particularly, the process according to the present invention is for producing an electrophotographic photosensitive member by introducing a gaseous silicon atom-containing raw material into a substantially enclosed reaction chamber having a discharge space, and supplying a microwave energy into the reaction chamber to generate a plasma in the discharge space to thereby form a film composed of a silicon-containing non-single crystal material as a light receiving layer on a substrate positioned in the reaction chamber, characterized by comprising the steps of:

(i) forming a film as a partial layer region of said light receiving layer, (ii) spacedly depositing a plurality of nucleuses, each capable of being a nucleus for growing a columnar structure region based on said nucleus, on said partial layer region respectively in an immobilized state, and (iii) repeating the film-forming step (i) to form a film on the surface of the above film having said plurality of nucleuses deposited thereon while growing a columnar structure region based on each of said plurality of nucleuses whereby a plurality of columnar structure regions are formed substantially in parallel in the thicknesswise direction at a density of $5/cm^2$ to $500/cm^2$.

The electrophotographic photosensitive member having the specific light receiving layer composed of a non-single crystal silicon material and containing a plurality of columnar structure regions being arranged substantially in parallel to the thicknesswise direction at a specific density according to the present invention is markedly advantageous in that the columnar structure regions function to prevent charges from flowing in the direction perpendicular to the thicknesswise direction of the light receiving layer composed of the non-single crystal silicon material and because of this, no smudging is occurred for an image reproduced and an improvement is attained in the resolution of said image reproduced, and in addition to this, the reflection of incident light at the surface of the electrophotographic photosensitive member, that at the layer interface, and that at the surface of the substrate are dispersed to diminish the occurrence of unevenness in terms of light reflection (that is, to diminish a difference in terms of the absorbed amount of light), resulting in making an image reproduced to be uniform in density as desired.

The process for producing an electrophotographic photosensitive member according to the present invention makes it possible to produce the above-described, improved electrophotographic photosensitive member at a high yield and at a low production cost.

The present inventors made studies of the reasons why the conventional electrophotographic photosensitive member is not satisfactory in terms of the density uniformity for an image reproduced, while focusing attention on the configuration thereof which usually comprises as a substrate and a multi-layered structure disposed on said substrate, comprising a plurality of layers each having a different function such as a charge generation layer, charge transportation layer, surface protective layer, charge injection inhibition layer, and the like. As a result, there were obtained findings as will be described in the following. That is, the layers stacked are more or less different from each other in terms of the reflective index and because of this, reflection of incident light occurs at each of the interfaces among the layers stacked, in addition, incident light is also reflected not only at the surface of the photosensitive member but also at the surface of the substrate, wherein those lights reflected interfere to strengthen or weaken with each other because they are different from each other in terms of optical path length. In this case, if the stacked structure should have a layered portion comprising a plurality of layers having an identical property, they are different from each other in terms of the thickness and incident angle of light, and because of this, the optical path length of incident light is different depending upon the position of the photosensitive member involved. This situation causes an unevenness in light reflection, which leads to providing an unevenness in terms of the density for an image reproduced.

In addition to the above, the present inventors made studies of the reasons why the conventional electrophotographic photosensitive member is not satisfactory in terms of the resolution for an image reproduced. As a result, there were obtained findings that in the electrophotographic image-forming process using the photosensitive member, charges are retained at the surface of the substrate and that of the light receiving layer by way of the corona discharging and charges present in a given region of the photosensitive member subjected to exposure are extinguished, wherein an electric field generated by the charges remained in non-exposed region of the photosensitive member makes some of the charges generated in the light receiving layer upon exposure to flow in the crosswise direction (that is, the direction perpendicular to the thicknesswise direction of the light receiving layer), resulting in causing a deterioration in the resolution of an image reproduced.

The present inventors made extensive studies in order to eliminate the above problems relating to the occurrence of uneven density and the occurrence of deterioration in the resolution for an image reproduced in the conventional electrophotographic photosensitive member. As a result, the present inventors obtained a knowledge that these problems could be solved by establishing a plurality of columnar structure regions in a light layer composed of a non-single crystal material as the light receiving layer disposed on the substrate such that they are spacedly arranged substantially in parallel to the thicknesswise direction of the layer.

In order to confirm whether or not this knowledge is practical, the present inventors conducted the following experiments.

EXPERIMENT 1

In this experiment, there were prepared a plurality of photosensitive member samples in a manner of scattering Si-powder as a nucleus for growing the foregoing columnar structure region on the surface of an Al substrate and forming a deposited film as a light receiving layer on the surface of the Al substrate. As for each of the photosensitive member samples, the deposited film as the light receiving layer was examined by the SEM. In addition, each of the photosensitive member samples was subjected to the electrophotographic image-forming process to examine its electrophotographic characteristics.

As the film-forming apparatus, there was used a fabrication apparatus of the constitution shown in FIGS. 2(A) and 2(B). The apparatus shown in FIGS. 2(A) and 2(B) is of the same constitution as the apparatus shown in FIGS. 6(A) and 6(B) except for the following points. That is, the former apparatus is additionally provided with supply ports 213 for supplying nucleuses for growing columnar structure regions and a mechanism for revolving the substrates 205 in addition to the mechanism for rotating each of them, which are not disposed in the apparatus shown in FIGS. 6(A) and 6(B).

Particularly, in FIGS. 2(A) and 2(B), reference numeral 201 indicates a reaction chamber, reference numeral 202 indicates a microwave introducing dielectric window made of an alumina ceramic which allows a microwave power to efficiently transmit into the reaction chamber 201 and can hermetically enclose the inside of the reaction chamber, and reference numeral 203 indicates a waveguide which serves to transmit a microwave power. The waveguide 203 is connected to a microwave power source (not shown) through a stub tuner (not shown) and an isolator (not shown). Reference numeral 204 indicates an exhaust pipe which is open into the reaction chamber 201 through one end thereof and is connected to an exhaust device (not shown) through the remaining end thereof. Reference numeral 206 indicates a discharge space circumscribed by a plurality of substrates 205. Reference numeral 211 indicates a D.C. power source (a bias power source) which serves to apply a D.C. voltage to a bias electrode 212. Reference numeral 214 indicates a sealing member, and reference numeral 216 indicates a revolution plate. Reference numeral 215 indicates a motor for rotating the revolution plate 216.

The formation of the light receiving layer was conducted as follows. The reaction chamber 201 containing a plurality of Al substrates 205 each being supported on a rotary shaft was evacuated through the exhaust pipe 204 to bring the inside to a vacuum of $1\times10^{-7}$ Torr. Then, the substrates 205 were heated to and maintained at a temperature of 250° C. by means of heaters 207. The substrates 205 were rotated by means of the motor 210 while revolving them by means of the motor 215. Herein, Si powder of 10 μm in mean particle size was supplied together with Ar gas into the reaction chamber 201 through the supply ports 213 for 2 minutes, under conditions of $2\times10^4$ Pa for the spouting pressure of the Si powder and 1000 sccm for the flow rate of the Ar gas, whereby the Si powder was spread over the surface of each substrate. Thereafter, $SiH_4$ gas, He gas, $CH_4$ gas, and $SiF_4$ gas were introduced into the reaction chamber 201 through gas feed means (not shown) at respective flow rates of 350 sccm, 100 sccm, 50 sccm, and 1 sccm. Successively, the gas pressure in the reaction chamber 201 was adjusted to and maintained at 4.0 mTorr. The microwave power source was then switched on to apply a microwave energy of 2.45 GHz in frequency and 1000 W in power into the reaction chamber 201. Simultaneously with this, a bias voltage of 70 V was applied through the bias electrode 212. By this, the raw material gases were excited and decomposed with the action of the microwave energy in the discharge space 206 to produce a plasma while causing ion bombardment by virtue of an electric field generated between the bias electrode 212 and the substrate 205, whereby an amorphous silicon carbide film containing hydrogen and fluorine atoms (a-SiC:H:F film) as the light receiving layer was formed on each of the substrates 205 at a thickness of 20 μm. Thus, there were obtained a plurality of photosensitive member samples. As for each of the resultant amorphous silicon carbide films each formed on the Al substrate 205, a part of which was cut to obtain a specimen for SEM examination, and the specimen was examined by means of the SEM. As a result, there were observed a plurality of cracks extending from the Si crystal nucleuses to the surface of the light receiving layer and a plurality of protrusions formed at the surface. In view of this, the light receiving layer of each of the photosensitive member samples was found to be inferior in terms of the quality.

In order to remove the protrusions at the surface of the light receiving layer, each photosensitive member sample was subjected to surface treatment by a polishing apparatus of the constitution shown in FIG. 3. The polishing apparatus shown in FIG. 3 is for grinding the surface of an object by fixing the object on the rotary shaft and rotating the rotary shaft while pressure contacting an abrasive tape to the surface of the photosensitive member on the rotary shaft.

The surface treatment of the photosensitive member by the polishing apparatus was conducted in the following manner. That is, a polishing unit 302 in the polishing apparatus body 301 was lifted upward and it was secured by a clamp 303. Then, the photosensitive member sample 305 was assembled with a supporting table 304 and the assembly was fixed to a rotary shaft 306. The clamp 303 was then loosed to lower the polishing unit 302, whereby an abrasive tape 308 was press-contacted with the surface of the photosensitive member sample 305 by means of a pressure roller 307. Herein, a polyester film applied with silicon carbide powder of 8 μm in mean particle size to the surface thereof was used as the abrasive tape 308, and as the pressure roller 307, there was used one having a coat composed of a urethane rubber of 80 in the JIS hardness.

In the above, the conditions upon press-contacting the abrasive tape 308 with the surface of the photosensitive member sample 305 through the pressure roller were made to be 40 g/cm in terms of linear load and 0.5 mm in contact width (nip width in other words) by regulating a pressure contacting spring 309. The surface treatment was conducted by actuating variable speed motors 310 and 311 for 5 minutes, wherein the abrasive tape 308 was moved at a feed speed of 10 mm/min., and the photosensitive member sample 305 was rotated at a rotation speed of 300 mm/sec.

In this way, the surface of each photosensitive member sample was treated. Each of the photosensitive member samples thus treated was set to a modification of the copying machine NP 9330 produced by CANON Kabushiki Kaisha for experimental purposes, in which image formation was conducted to reproduce a character original in order to evaluate the electrophotographic characteristics of the photosensitive member sample. As a result, as for each of the photosensitive members dedicated for the evaluation, it was found that images reproduced at the initial stage seem acceptable in terms of the image quality but thereafter, as the image formation is repeated, the quality of an image reproduced becomes exacerbated, wherein there is provided such an image that the characters reproduced are hardly recognized.

The reason why any of the photosensitive member samples is poor in electrophotographic characteristics is considered to be due to the cracks in the deposited film as the light receiving layer which occurred as a result of the deposited film having been formed on the Si crystal nucleuses unstably deposited on the Al substrate.

EXPERIMENT 2

In this experiment, taking the results obtained in Experiment 1 into consideration, the spread of the Si fine particles as the columnar structure region growing nucleuses onto the Al substrates was conducted after a deposited film had been formed on each of the substrates at a certain thickness. That is, the procedures of Experiment 1 were repeated, except that the step of spreading the Si fine particles onto each of the Al substrates was conducted after a deposited film had been formed on each of the substrates at a certain thickness.

Particularly, there were prepared a plurality of photosensitive member samples in the following manner. The reaction chamber 201 was evacuated to bring the inside to a desired vacuum. Then, the Al substrates 205 were heated to and maintained at a temperature of 250° C. The substrates 205 were rotated while revolving them. $SiH_4$ gas, He gas, $CH_4$ gas, and $SiF_4$ gas were then introduced into the reaction chamber 201 at respective flow rates of 350 sccm, 100 sccm, 50 sccm, and 1 sccm. Successively, the gas pressure in the reaction chamber 201 was adjusted to and maintained at 4.0 mTorr. The microwave power source was then switched on to apply a microwave energy of 2.45 GHz in frequency and 1000 W in power into the reaction chamber 201. Simultaneously with this, a bias voltage of 70 V was applied through the bias electrode 212. By this, an amorphous silicon carbide film containing hydrogen and fluorine atoms (a-SiC:H:F film) as the light receiving layer was formed on each of the substrates 205 at a thickness of 5 μm. Thereafter, the microwave power source and the bias power source were switched off and the introduction of the raw material gases was suspended. Then, Si powder of 10 μm in mean particle size was supplied together with Ar gas into the reaction chamber 201 through the supply ports 213 for 2 minutes, under conditions of $2\times10^4$ Pa for the spouting pressure of the Si powder and 1000 sccm for the flow rate of the Ar gas, whereby the Si powder was spread on the surface of the 5 μm thick amorphous silicon carbide film (the a-SiC:H:F film) formed on each of the substrates. Successively, the above film-forming procedures of introducing the raw material gases into the reaction chamber 201 and applying the microwave energy into the reaction chamber while applying the bias voltage through the bias electrode 212 were repeated to thereby stack a 15 μm thick amorphous silicon carbide film (a-SiC:H:F film).

Thus, there were obtained a plurality of photosensitive member samples. Each of the resultant amorphous silicon carbide films each formed on the substrate was examined by the SEM in the same manner as in Experiment 1. As a result, there were observed a plurality of columnar regions grown from the Si crystal nucleuses spread on the initially formed 5 μm thick amorphous silicon carbide film (the a-SiC:H:F film) apparently in parallel to the thicknesswise direction. In this case, there were observed some Si crystal nucleuses from which no columnar region having been grown.

Each photosensitive member sample was subjected to surface treatment by the polishing apparatus shown in FIG. 3 in the same manner as in Experiment 1. Each of the photosensitive member samples thus treated was subjected to image formation in the same manner as in Experiment 1, in order to evaluate the electrophotographic characteristics of the photosensitive member sample. As a result, it was found that each of the photosensitive member samples reproduces images which are markedly surpassing those reproduced by the photosensitive member samples obtained in Experiment 1. However, as for each of the photosensitive members dedicated for the evaluation, it was found that images reproduced after about 50,000 times image-forming shots are distinguishably inferior in terms of the image quality (specifically, deterioration in the resolution and occurrence of white spots). In order to ascertain the reason for this, as for each of the photosensitive members having been subjected to the repetitive image-forming shots of more than 50,000 times, a part of the deposited film as the light receiving layer formed on the Al substrate was cut to obtain a specimen for SEM examination, and the specimen was examined by means of the SEM. As a result, there were observed a plurality of columnar regions grown from the Si crystal nucleuses spread on the initially formed 5 μm thick amorphous silicon carbide film (the a-SiC:H:F film) and which are arranged apparently in parallel to the thicknesswise direction and in addition to these columnar regions, a plurality of coarse regions each comprising a Si crystal nucleus with no deposited film. It is considered that these coarse regions would entail the deterioration in the resolution and occurrence of white spots for the images reproduced. As such coarse regions occurred in the deposited film as the light receiving layer, it is considered that they would have been occurred due to those Si crystal nucleuses insufficiently immobilized on the initially formed amorphous silicon carbide film.

EXPERIMENT 3

In this experiment, in order for Si-powder to be spread such that Si crystal nucleuses are deposited on the surface of an amorphous silicon carbide film (that is, an a-SiC:H:F film), which is initially formed, respectively in an immobilized state, the Si-powder was electrically charged and it was spread over the surface of the amorphous silicon carbide film (the a-SiC:H:F film) formed on each substrate so that the Si crystal nucleuses were deposited on the amorphous silicon carbide film by virtue of an electric field generated between the Si-powder and substrate. The film formation in this experiment was conducted by using a modification of the film-forming apparatus shown in FIGS. 2(A) and 2(B), which is additionally provided with a charger comprising a tungsten wire of 0.5 mm in diameter disposed at each of the supply ports 213, a mechanism of applying a D.C. voltage to the charger so as to cause corona discharge thereby charging the Si-powder upon supplying it into the reaction chamber, and a mechanism for applying a D.C. bias voltage to the substrates 205.

In this experiment, the procedures of Experiment 2 were repeated, except that the step of spreading the Si-powder on each substrate was conducted while charging the Si-powder, applying a D.C. bias voltage to each Al substrate 205, and utilizing an electric field between the Si-powder and substrate.

Particularly, there were prepared a plurality of photosensitive member samples in the following manner. The reaction chamber 201 was evacuated to bring the inside to a desired vacuum. Then, the Al substrates 205 were heated to and maintained at a temperature of 250° C. The substrates 205 were rotated while revolving them. $SiH_4$ gas, He gas, $CH_4$ gas, and $SiF_4$ gas were then introduced into the reaction chamber 201 at respective flow rates of 350 sccm, 100 sccm, 50 sccm, and 1 sccm. Successively, the gas pressure in the reaction chamber 201 was adjusted to and maintained at 4.0 mTorr. The microwave power source was then switched on to apply a microwave energy of 2.45 GHz in frequency and 1000 W in power into the reaction chamber 201. Simultaneously with this, a bias voltage of 70 V was applied through the bias electrode 212. By this, an amorphous silicon carbide film containing hydrogen and fluorine atoms (a-SiC:H:F film) as the light receiving layer was formed on each of the substrates 205 at a thickness of 5 μm. Thereafter, the microwave power source and the bias power source were switched off and the introduction of the raw material gases was suspended. Then, while applying a D.C. voltage of 5 kV to the charger disposed at each of the supply port 213 to cause corona discharge whereby charging Si-powder and applying a D.C. voltage of −100 V to each of the Al substrates, the Si-powder was supplied together with Ar gas into the reaction chamber 201 through the supply ports 213 for 2 minutes under conditions of $2\times10^4$ Pa for the spouting pressure of the Si-powder and 1000 sccm for the flow rate of the Ar gas, whereby the Si powder was spreaded on the surface of the amorphous silicon carbide film formed on each of the substrates. Thereafter, the application of the D.C. voltage to the Al substrates was terminated. Successively, the above film-forming procedures of introducing the raw material gases into the reaction chamber and applying the microwave energy into the reaction chamber while applying the bias voltage through the bias electrode 212 were repeated to thereby stack a 15 μm thick amorphous silicon carbide film (a-SiC:H:F film).

Thus, there were obtained a plurality of photosensitive member samples. Each of the resultant amorphous silicon carbide films individually formed on the substrate was examined by the SEM as well as in Experiment 2. As a result, there were observed a plurality of columnar regions grown from all the Si crystal nucleuses spread on the initially formed 5 μm thick amorphous silicon carbide film (the a-SiC:H:F film) apparently in parallel to the thicknesswise direction.

Each photosensitive member sample was subjected to surface treatment by the polishing apparatus shown in FIG. 3 as well as in Experiment 2. Each of the photosensitive member samples thus treated was subjected to image formation as well as in Experiment 2, in order to evaluate the electrophotographic characteristics of the photosensitive member sample. As a result, it was found that each of the photosensitive member samples reproduces images which are surpassing those reproduced by the photosensitive member samples obtained in Experiment 2, wherein images reproduced after 100,000 image-forming shots excel in quality without being accompanied by such defects that were found in the above experiment. As for the reason why each of the photosensitive member samples provides high quality reproduced images even after having repeated the image formation over a long period of time, it is considered such that the Si crystal nucleuses from the Si-powder were deposited on the initially formed amorphous film in immobilized state upon spreading the Si-powder and a plurality of columnar structure regions were grown from all the Si crystal nucleuses such that they are arranged apparently in parallel to the thicknesswise direction.

EXPERIMENT 4

In this experiment, based on the results obtained in Experiment 3, studies were made in order to find out a desirable range for the density of the columnar structure regions formed in the deposited film as the light receiving layer.

In this experiment, there were prepared a variety of photosensitive members of the configuration shown in FIG. 1(A). In FIG. 1(A), reference numeral 102 indicates a substrate, and reference numeral 104 indicates a layer which functions as a photoconductive layer, wherein the layer is composed of a non-single crystal material (an amorphous material, microcrystalline material or polycrystalline material) containing silicon atoms as a matrix. Reference numeral 103 indicates a charge injection inhibition layer, and reference numeral 105 indicates a surface layer. Reference numeral 110 indicates a columnar structure region, and reference numeral 111 indicates a crystal nucleus for the columnar structure region.

For each photosensitive member, there were prepared a plurality of photosensitive member samples using the film-forming apparatus used in Experiment 3 as will be described below.

That is, the reaction chamber 201 was evacuated to bring the inside to a desired vacuum. Then, the Al substrates 205 were heated to and maintained at a temperature of 250° C. The substrates 205 were rotated while revolving them. $SiH_4$ gas, He gas, $B_2H_6$ gas, and NO gas were then introduced into the reaction chamber 201 at respective flow rates of 350 sccm, 100 sccm, 1000 ppm, and 10 sccm. The gas pressure in the reaction chamber 201 was adjusted to and maintained at 4.0 mTorr. The microwave power source was then switched on to apply a microwave energy of 2.45 GHz in frequency and 1000 W in power into the reaction chamber 201. Simultaneously with this, a bias voltage of 70 V was applied through the bias electrode 212. By this, a 3 μm thick a-Si:H:N:B film as the charge injection inhibition layer 103 on each of the Al substrates 205. Then, the introduction of the $B_2H_6$ gas and NO gas was terminated, and while continuing the introduction of the $SiH_4$ gas and He gas into the reaction chamber 201, $CH_4$ gas and $SiF_4$ were additionally introduced into the reaction chamber at respective flow rates of 50 sccm and 1 sccm, to thereby form a 5 μm thick a-SiC:H:F film on the above film. Thereafter, the microwave power source (not shown) and the bias power source were switched off and the introduction of the raw material gases was suspended. Then, while applying a D.C. voltage of 5 kV to the charger disposed at each of the supply port 213 to cause corona discharge whereby charging Si-powder and applying a D.C. voltage of −100 V to each of the Al substrates, the Si-powder was supplied together with Ar gas into the reaction chamber 201 through the supply ports 213 for a given period of time in the range of 10 seconds to 5 minutes under conditions of $2\times10^4$ Pa for the spouting pressure of the Si-powder and 800 sccm for the flow rate of the Ar gas, whereby the Si powder was spreaded on the surface of the amorphous silicon carbide film formed on each of the substrates 205. Thereafter, the application of the D.C. voltage to the Al substrates was terminated. Then, the above film-forming procedures of introducing the raw material gases into the reaction chamber and applying the microwave energy into the reaction chamber while applying the bias voltage through the bias electrode 212 were repeated to thereby stack a 15 μm thick a-SiC:H:F film, whereby a photoconductive layer 104 was formed. On the photoconductive layer on each of the substrates, a 0.5 μm thick a-SiC:H film as the surface layer 105 under the film-forming conditions shown in Table 1. The film-forming conditions employed for the formation of the layers 103, 104 and 105 are collectively shown in Table 1. Thus, there were obtained a variety of photosensitive members which are different with respect to the period of time during which the Si-powder was supplied.

Each of the photosensitive members obtained was subjected to surface treatment by the polishing apparatus shown in FIG. 3 as well as in Experiment 2.

The photosensitive member thus treated was set to the modification of the copying machine NP 9330 produced by CANON Kabushiki Kaisha for experimental purposes, wherein image formation was conducted using a given test chart to reproduce images. Based on the images reproduced, evaluation was conducted with respect to the electrophotographic characteristics. The evaluated results obtained are collectively shown in Table 2. The evaluation of each of the evaluation items shown in Table 2 was conducted in the manner as will be described below.

(1) Photosensitivity Evenness

Image formation was conducted using a whole halftone original to reproduce image samples. Of the resultant image samples, the worst sample in terms of the density evenness was dedicated for the evaluation of the photosensitivity evenness of the photosensitive member in the following manner.

That is, nine equal square regions were apparently established at the surface of the photosensitive member by axially dividing the surface into three equal parts and circumferentially dividing the surface into three equal parts. And the optical density of each of the corresponding nine square regions on the image sample was examined, and a mean value among the resultant nine optical densities was obtained. Then, the optical density of each square region was compared with the mean value. Based on the compared results, evaluation was made in accordance with was the following criteria. The evaluated result is shown in the table.

⊙: no substantial difference is recognized among the nine square regions,

○: a slight difference is recognized as for one or two of the nine square regions, Δ: all the square regions are different but their different magnitude is slight, and X: problematic differences are present among the nine square regions.

(2) Resolution

Image formation was conducted using an original having minute characters on a white background to reproduce image samples. As for the resultant image samples, examination was made of whether or not the images reproduced are equivalent to the minute characters of the original. Of the image samples, the worst one is shown in the table based on the following criteria.

⊙: excellent in resolution,

○: slightly crashed parts are present,

Δ: many apparently crashed parts are present but the reproduced characters can be recognized, and x: markedly crashed parts are present and wherein some of the reproduced characters are hardly recognized.

(3) Appearance of Interference Fringe Pattern

Evaluation was made of whether or not the photosensitive member is liable to provide an interference infringe patter on an image reproduced due to the presence of an unevenness in the thickness of the light receiving layer. That is, image formation was conducted using a whole halftone original and a solid black original in combination to reproduce image samples. The resultant image samples were evaluated based on the following criteria. The evaluated result is shown in the table.

⊙: no interference fringe pattern is found in any of the image samples,

○: a slight interference fringe pattern is found in some of the halftone image samples, Δ: a distinguishable interference fringe pattern is found in all the halftone image samples but not in the solid black image samples, and X: a distinct interference fringe pattern is found in any of the image samples.

(4) Appearance of Coarseness

Evaluation was made of whether or not the photosensitive member is liable to provide a coarseness on an image reproduced. That is, image formation was conducted by using a whole halftone original and an original having minute characters on a white background in combination to reproduce image samples. The resultant image samples were evaluated based on the following criteria. The evaluated result is shown in the table.

⊙: no coarseness is found in any of the image samples,

○: a slight coarseness is found in some of the halftone image samples,

Δ: a distinct coarseness is found in any of the halftone image samples but no coarseness is found in any of the image samples reproduced from the character original, and X: a distinct coarseness is found also in any of the image samples reproduced from the character original wherein some of the reproduced characters are hardly recognized.

From the results shown in Table 2, it is understood that in the case where the photosensitive member is designed to have a light receiving layer comprising a deposited film containing a plurality of columnar structure regions formed at a given density in the range of 5/cm$^2$ to 500/cm$^2$ therein, it exhibits markedly improved electrophotographic characteristics, particularly with respect to occurrence of uneven density, resolution, appearance of an interference fringe pattern, and appearance of a coarseness for an image reproduced.

Based on the results obtained in the above Experiments 1 to 4, there was obtained a finding that in the case of forming a layer composed of a non-single crystal material on a substrate, depositing on the surface of the layer a plurality of particles each capable of being a crystal nucleus for growing a columnar structure region therefrom in immobilized state, and additionally forming a layer composed of a non-single crystal material thereon while growing a plurality of columnar structure regions based on the respective crystal nucleuses at a given density in the range of 5/cm$^2$ to 500/cm$^2$ and substantially in parallel to the thicknesswise direction, there is afforded a light receiving member which exhibits markedly improved electrophotographic characteristics, particularly with respect to occurrence of uneven density, resolution, appearance of an interference fringe pattern, and appearance of a coarseness for an image reproduced.

DESCRIPTION OF THE PREFERRED EMBODIMENTS

An aspect of the present invention is directed to an electrophotographic photosensitive member comprising a substrate and a light receiving layer composed of a non-single crystal material containing silicon atoms as a matrix disposed on said substrate, characterized in that said light receiving layer contains a plurality of columnar structure regions each grown from a given nucleus situated within said light receiving layer wherein said plurality of columnar structure regions are arranged substantially in parallel to the thicknesswise direction of said light receiving layer and at a density in the range of 5/cm$^2$ to 500/cm$^2$.

Another aspect of the present invention is directed to a process for producing an electrophotographic photosensitive member by introducing a gaseous silicon-containing raw material into a substantially enclosed reaction chamber having a discharge space, and supplying a microwave energy into the reaction chamber to generate a plasma in the discharge space to thereby form a film composed of a silicon-containing non-single crystal material as a light receiving layer on a substrate positioned in the reaction chamber, characterized by comprising the steps of:

(i) forming a film as a partial layer region of said light receiving layer, (ii) spacedly depositing a plurality of nucleuses, each capable of being a nucleus for growing a columnar structure region based on said nucleus, on the surface of said film in an immobilized state, and (iii) repeating the film-forming step (i) to form a film on the surface of said film having said plurality of nucleuses thereon while growing a columnar structure region based on each of said plurality of nucleuses whereby a plurality of columnar structure regions are formed substantially in parallel to the thicknesswise direction and at a density in the range of 5/cm$^2$ to 500/cm$^2$.

In the following, description will be made of the electrophotographic photosensitive member according to the present invention with reference to FIG. 1(A).

Figure 1:
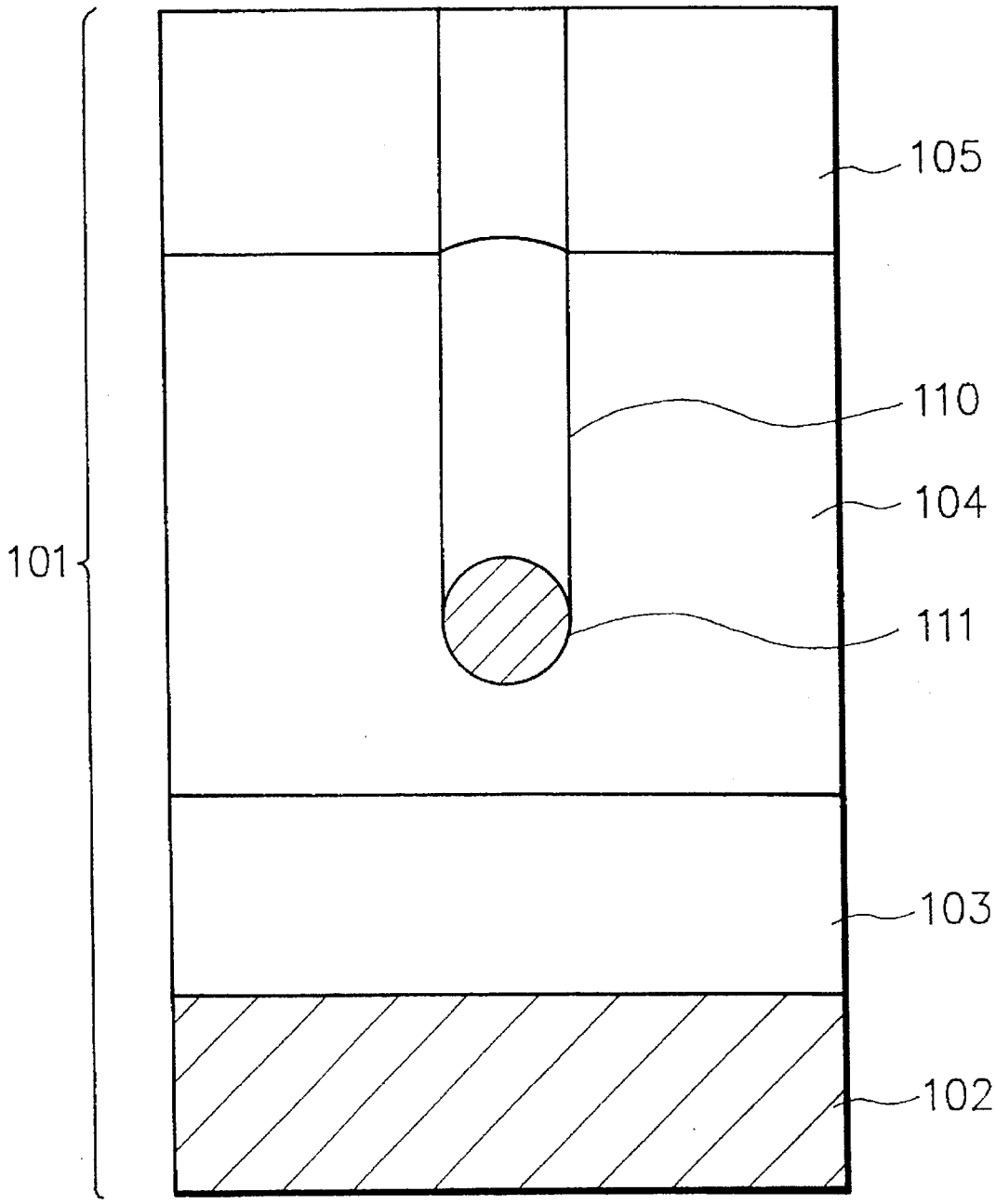
FIGS. 1(A) through 1(E) are schematic cross sectional views each illustrating an example of an electrophotographic photosensitive member according to the present invention.
FIG. 1(F) is a schematic view showing incident path and reflection path of rays of light in an electrophotographic photosensitive member according to the present invention.
Figure 1:
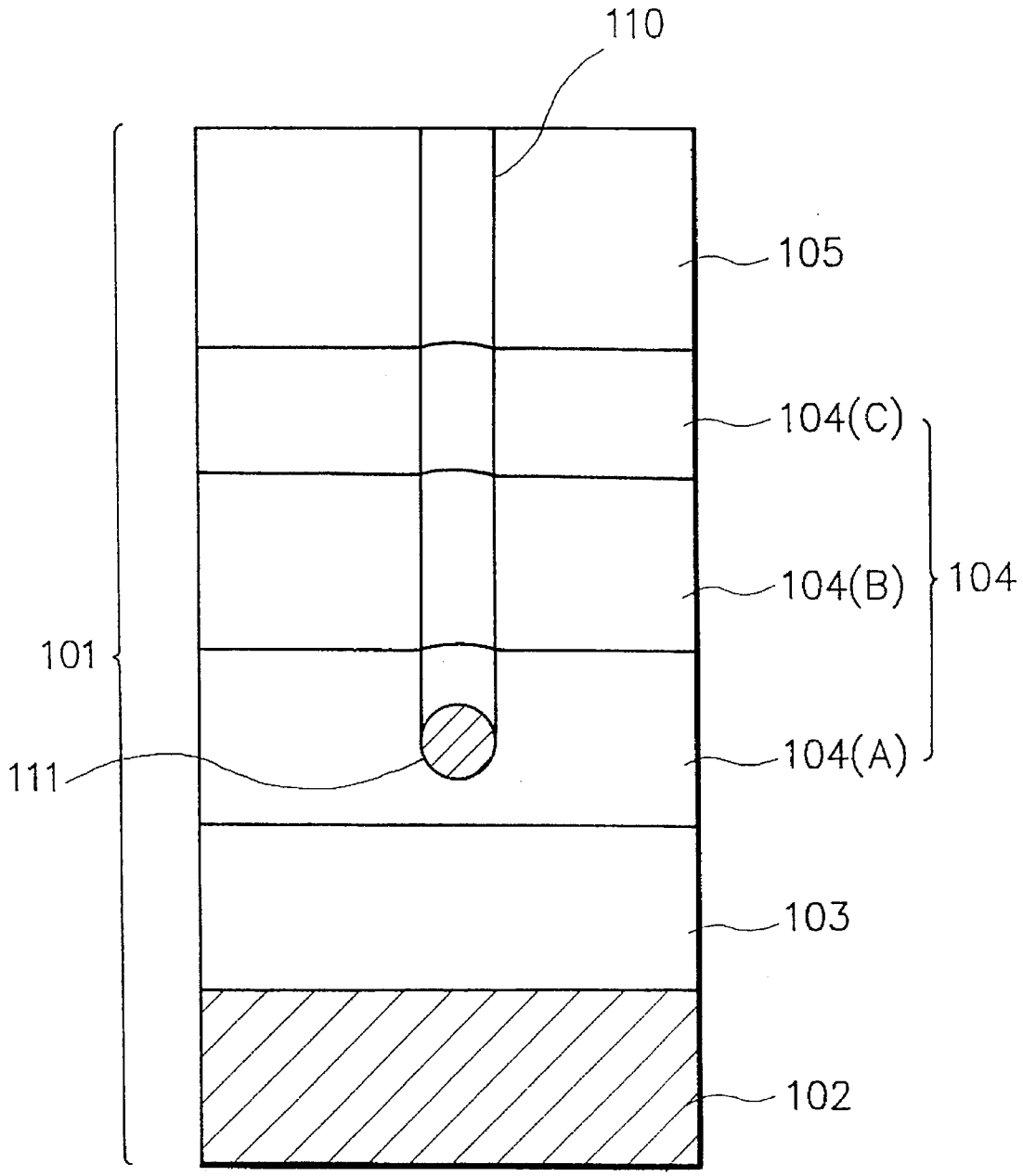
Figure 1:
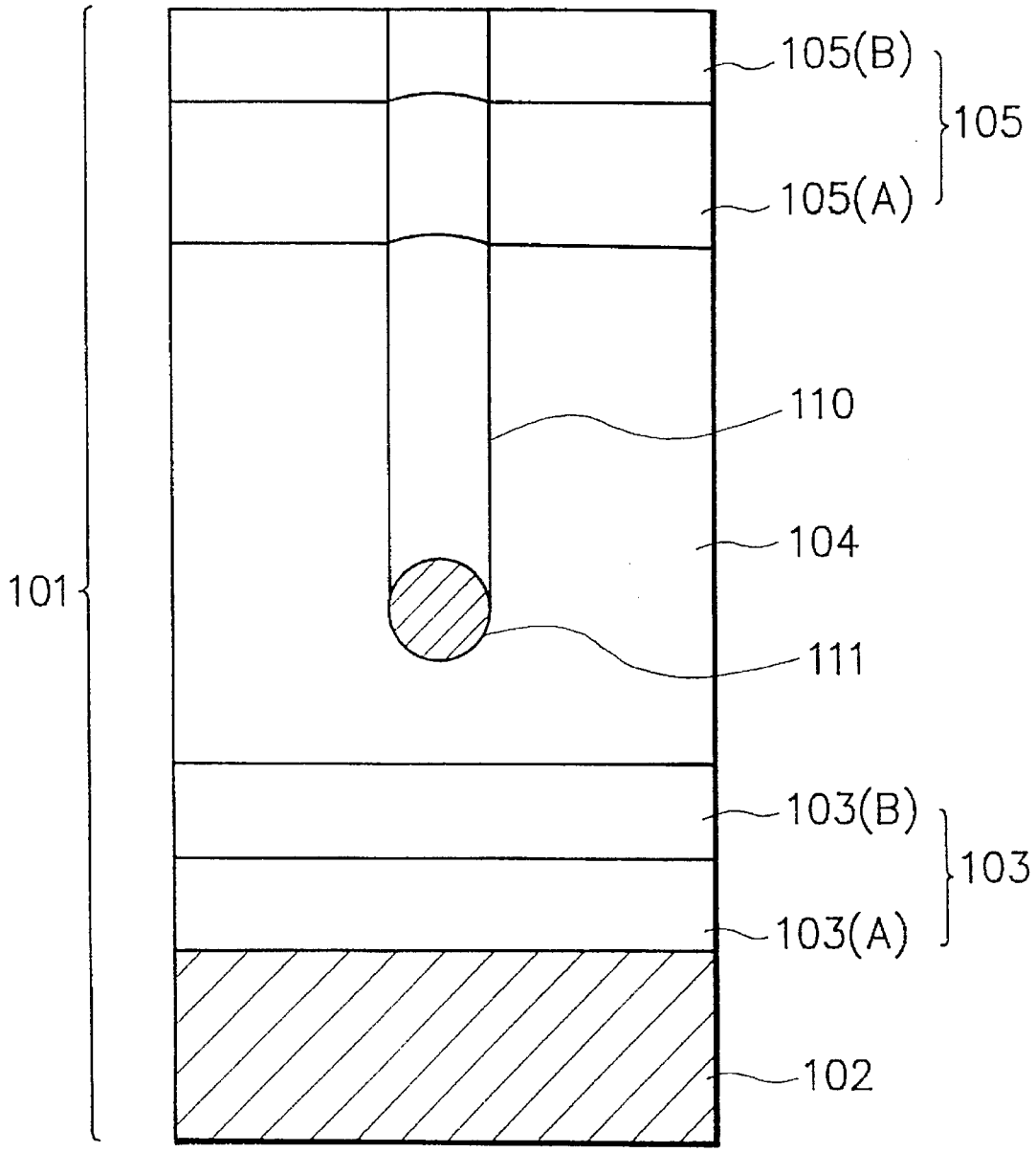
Figure 1:
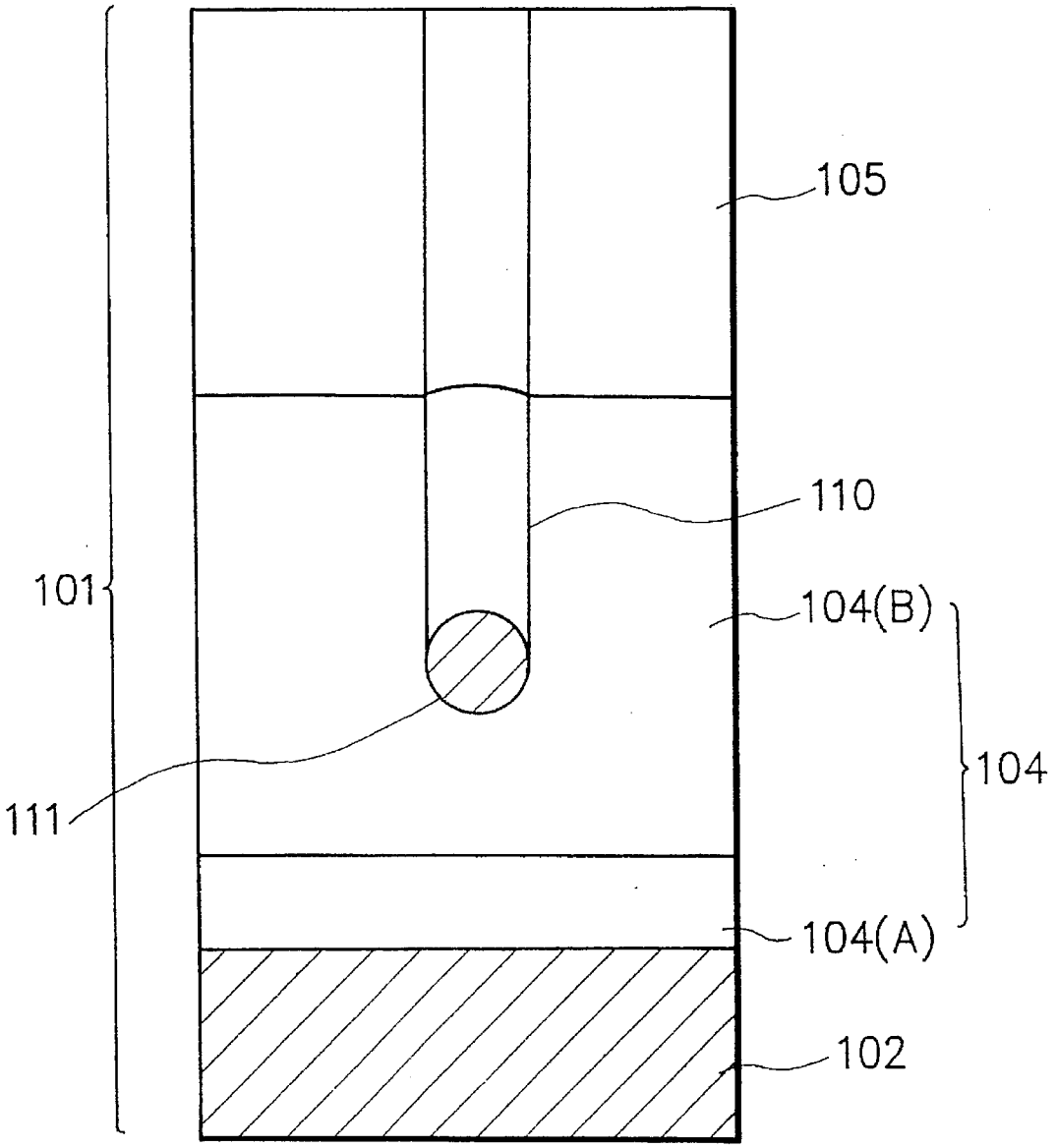
Figure 1:
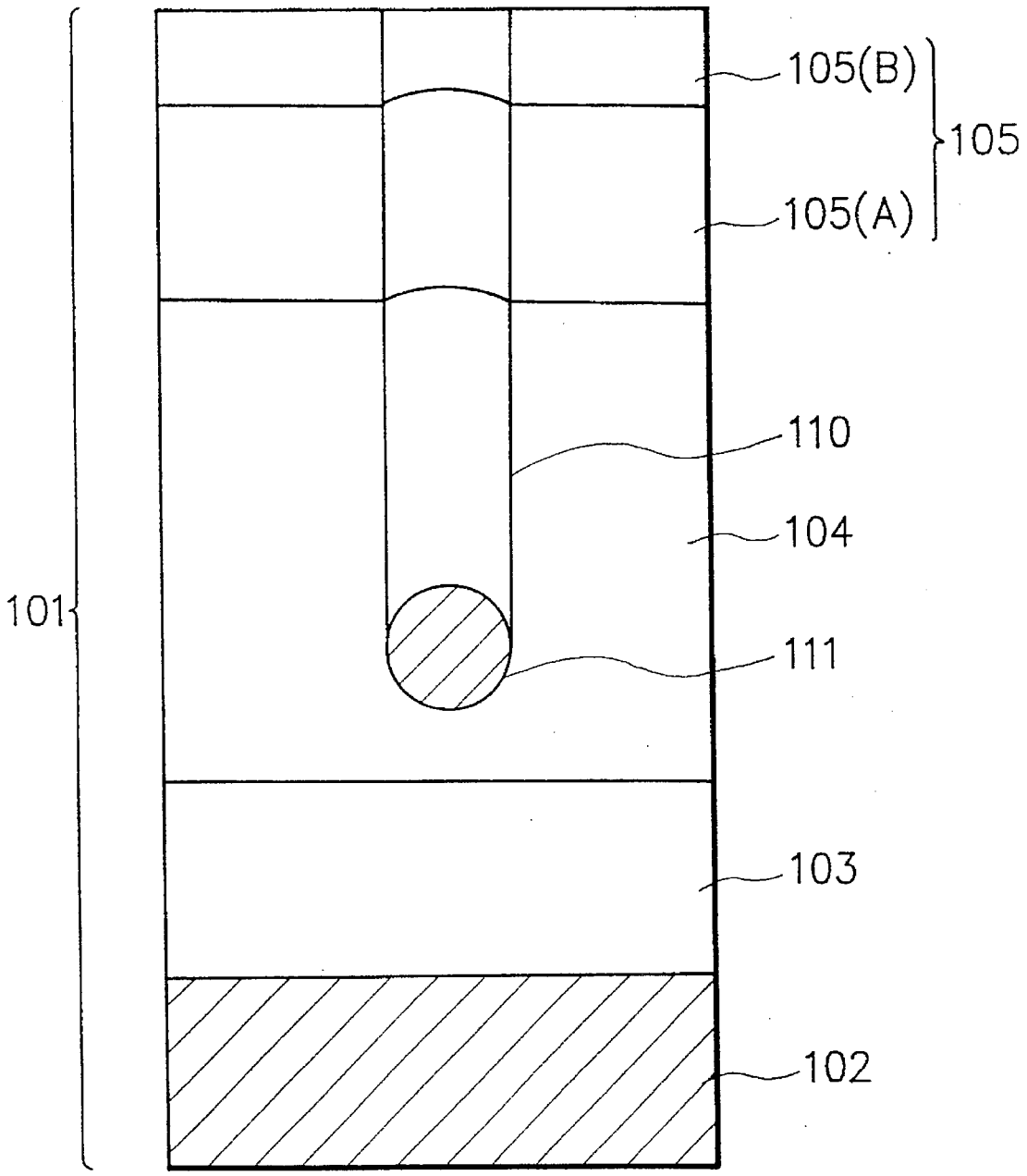
Figure 1:
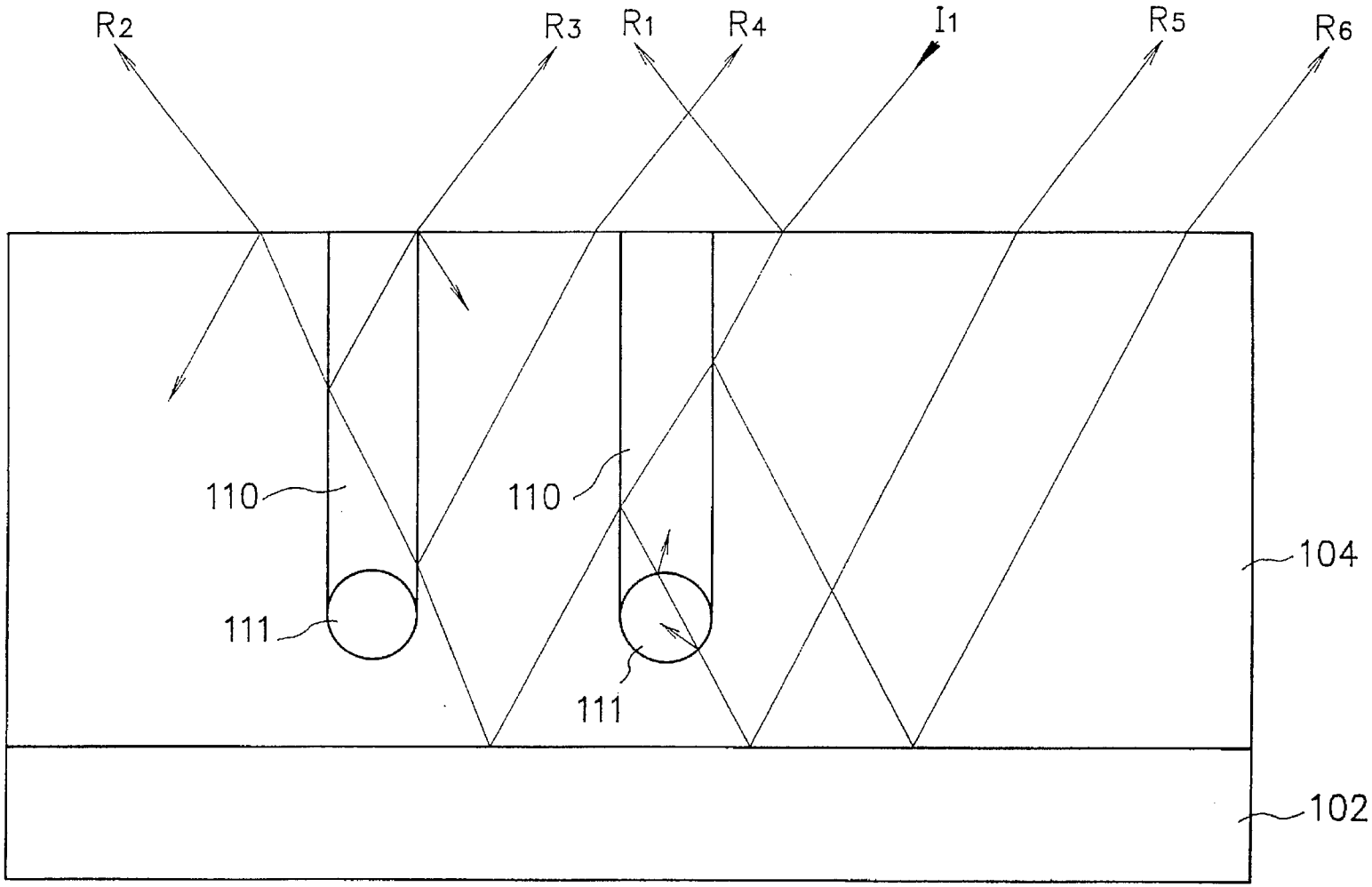

In FIG. 1(A), reference numeral 102 indicates a substrate, and reference numeral 104 indicates a layer capable of functioning as a photoconductive layer which is composed of a non-single crystal material (specifically, an amorphous, microcrystalline or polycrystalline material) containing silicon atoms as a matrix. Reference numeral 110 indicates a columnar structure region, and reference numeral 111 indicates a nucleus for said columnar structure region. Reference numeral 103 indicates a charge injection inhibition layer, and reference numeral 105 indicated a surface layer. The charge injection inhibition layer 103 and the surface layer 105 are not always necessary to be disposed, and these layers may be optionally disposed depending upon the characteristics desired for an electrophotographic photosensitive member to be obtained.

The electrophotographic photosensitive member according to the present invention is free of the problems such as occurrence of uneven image density and deterioration in resolution which are found in the conventional electrophotographic photosensitive member and stably and continuously exhibits excellent image-forming characteristics. This situation will be described while referring to FIG. 1(F).

FIG. 1(F) is a schematic view for explaining how light travels when the light is impinged into the photoconductive layer 104 composed of a non-single crystal material containing silicon atoms as a matrix. In FIG. 1(F), each columnar structure region 110 and each nucleus 111 for the columnar structure region establish respective interfaces in the non-single crystal material layer 104. The refractive index of the columnar structure region 110 is different from that of the non-single crystal material layer region 104, and because of this, ray of incident light $I_1$ is repeatedly reflected at the interface between these regions to provide reflected rays $R_1$ to $R_6$. The reflected rays $R_1$ to $R_6$ have a different optical path length respectively, and because of this, they interfere with each other to strengthen or weaken their intensity, wherein however, the presence of the columnar structure regions 110 makes those rays to more frequently reflect whereby the opportunities for the rays to interfere with each other are distributed to prevent the rays from being strengthened or weakened at a specific position.

Further, in the electrophotographic photosensitive member, a charge Generated in the photoconductive layer upon subjecting it to exposure are prevented from being pulled and drifted by virtue of an electric field of the residual charge in the non-exposed portion because of the presence of the columnar structure regions 110.

In the electrophotographic photosensitive member of the present invention, the layer 104 composed of a non-single crystal material containing silicon atoms as a matrix may be of a stacked structure comprising a plurality of layers, for example, layers 104(A), 104(B) and 104(C) as shown in FIG. 1(B). Similarly, each of the layer 103 and the layer 105 may be of a stacked structure comprising a plurality of layers each being different in terms of the chemical composition. Alternatively, the layer 103 and the layer 105 may be designed such that the former functions as a light absorption layer capable of preventing light from being reflected from the substrate or a charge transportation layer, and the latter functions as a charge generation layer. In a preferred embodiment, the layer 103 is designed to function as a light absorption layer and/or a charge injection inhibition layer, and the layer 105 is designed to function as a charge Generation layer and/or a surface layer. Specifically, the layer 103 and the layer 105 may be composed of a material selected from the group consisting of non-single crystal materials (including amorphous and polycrystalline materials) containing silicon atoms as a matrix, and one or more kinds of atoms selected from the group consisting of carbon, germanium, nitrogen, oxygen, hydrogen, fluorine, boron, and phosphorous atoms.

As for the columnar structure region formed in the light receiving layer in the present invention, it is configured to have a circular shape, an elliptical shape or other shape comprising these shapes being overlapped in terms of the cross-sectional shape provided when the columnar structure region-containing light receiving layer is cut in the direction horizontal to the free surface thereof. In addition, as for the cross-sectional shape of the columnar structure region provided when the columnar structure region-containing light receiving layer is cut in the direction perpendicular to the free surface thereof, it is desired to be of a rectangular shape, a triangular shape, a trapezoidal shape, or other shape comprising a combination of these shapes.

As for the size of the columnar structure region, it is desired to be preferably in the range of 1 μm to 300 μm or more preferably in the range of 5 μm to 100 μm in terms of the diameter (or the major axis) when looked from the free surface side of the light receiving layer. In the case where the columnar structure region is of a size of less than the above lower limit, the effects of the present invention are not provided as desired. On the other hand, in the case where it is of a size of exceeding the above upper limit, desirable electrophotographic characteristics are not provided.

In a preferred embodiment of the present invention, a plurality of columnar structure regions each having any of the above-described shapes and having a size of 5 μm to 100 μm in terms of the diameter (or the major axis) are formed to arrange substantially in parallel to the thicknesswise direction at a given density preferably in the range of $5/cm^2$ to $500/cm^2$, more preferably in the range of $10/cm^2$ to $300/cm^2$ most preferably in the range of $10/cm^2$ to $100/cm^2$ in the light receiving layer. In the case where the density for the columnar structure regions to be arranged is less than the above lower limit, the effects of the present invention are not provided as desired. On the other hand, in the case where it exceeds the above upper limit, desirable electrophotographic characteristics are not provided, wherein defects including occurrence of coarseness and the like entail for an image reproduced.

In the present invention, as the nucleus for growing the columnar structure region based on it, any material can be used as long as it is a fine particle. However, it is preferred to use a powder of a crystalline material such a silicon-containing single crystal material or a silicon-containing polycrystalline material. Alternatively, it is possible to use a powder of a non-single crystal material.

In the present invention, the position at which the columnar structure region starts growing in the light receiving layer is an important factor. It is desired to be set at the position which is distant preferably by 1 μm or more, more preferably by 3 μm or more, most preferably 5 μm or more, from the position where the lower interface thereof is situated in the thicknesswise direction.

In order to form a plurality of the foregoing columnar structure regions in the light receiving layer, as previously described, a given deposited film is firstly formed and then, a plurality of nucleuses for growing the columnar structure regions are spread over the deposited film to deposit them on the surface of the deposited film. In a preferred embodiment of the manner of doing this, those nucleuses are firstly electrically charged, the electrically charged nucleuses are then introduced into the reaction chamber together with rare gas such as helium gas, neon gas or argon gas, hydrogen gas, or film-forming raw material gas such as silane gas or methane gas to spread them over the deposited film wherein they are deposited on the surface of the deposited film in immobilized state by virtue of an electric field generated between the electrically charged nucleuses-and the substrate.

To make fine particles as the nucleuses electrically charged may be conducted by means of a conventional charge-imparting manner such as corona discharge, spark discharge or glow discharge technique. Specifically, for instance, in the case where the corona discharge technique, the fine particles can be electrically charged by using a charger provided with a charging wire comprising s stainless steel or tungsten wire of 0.1 to 0.5 mm in diameter and applying a D.C. voltage of 4 to 8 V to the charger to thereby cause corona discharge.

The fine particles bearing charges thus obtained are introduced into the reaction chamber by spouting them thereinto at an appropriate spouting pressure by the aid of any of the foregoing gases which is flown at a given flow rate. The flow rate of the gas and the pressure for the charge-bearing fine particles to be spouted should be properly determined depending upon the related conditions including the size and amount of the charge-bearing fine particles, the surface area of the film on which the charge-bearing fine particles are to be spread and the period of time during which the charge-bearing fine particles are spread. However, in general, it is desired that the flow rate of the gas is in the range of 100 sccm to 100 slm and the spouting pressure is in the range of $10^4$ Pa to $10^5$ Pa.

And in order to deposit the charge-bearing fine particles on the surface of a given deposited film by virtue of an electric field generated between the charge-bearing fine particles and the substrate, the intensity of the electric field is desired to be in the range of 1 V/cm to 100 V/cm.

In the present invention, the silicon-containing non-single crystal material by which the layer 104 is constituted is desired to contain carbon atoms in an amount of 2.0 atomic % to 25 atomic % versus the amount of the silicon atoms and fluorine atoms in an amount of 2 atomic ppm to 90 atomic ppm versus the amount of the silicon atoms.

The silicon-containing non-single crystal material layer 104 may be formed by using, in addition to a silicon atom-imparting raw material gas such as silane and disilane, a carbon atom-imparting raw material gas selected from the group consisting of methane ($CH_4$), ethane ($C_2H_5$), ethylene ($C_2H_4$), acetylene ($C_2H_2$), propane ($C_3H_8$) and mixtures of these gases. Alternatively, it is possible to use tetramethylsilane ($Si(CH_3)_4$) capable of imparting silicon and carbon atoms at the same time. In order to incorporate fluorine atoms into the silicon-containing non-single crystal material layer 104, there is used a gaseous fluoride such as silicon tetrafluoride ($SiF_4$), carbon tetrafluoride ($CF_4$) and a mixture of these.

In a preferred embodiment of the amount of the carbon atoms contained in the layer 104, it is preferably in the range of 2 atomic % to 20 atomic %, most preferably in the range of 3 atomic % to 10 atomic %, respectively versus the amount of the silicon atoms contained in the layer 104.

In a preferred embodiment of the amount of the fluorine atoms contained in the layer 104, it is preferably in the range of 2 atomic ppm to 90 atomic ppm, most preferably in the range of 3 atomic ppm to 80 atomic ppm versus the amount of the silicon atoms contained in the layer 104.

The layer 104 is desired to be of a thickness preferably in the range of 30% to less than 100%, more preferably in the range of 50% to less than 100%, versus the total layer thickness on the substrate.

In the present invention, the layer 104 may be desirably formed by means of the microwave plasma CVD technique. In this case, it is effective to conduct film formation while applying a desired bias voltage in the discharge space such that an electric field is caused at least in the direction in which a positive ion collides with the substrate. In the case where no bias voltage is applied upon the film formation, the effects of the present invention are not provided as desired.

The above bias voltage can include a voltage of D.C. The D.C. voltage applied is desired to be preferably in the range of 1 V to 500 V, more preferably in the range of 5 V to 100 V.

The formation of each of the layer 103 and the layer 105 may be conducted by means of the vacuum evaporation, sputtering, thermal-induced CVD, or plasma CVD technique.

The substrate used in the present invention can include, for example, metals such as stainless steel, Al, Cr, Mo, Au, In, Nb, Te, V, Ti, Pt, Pd, and Fe, alloys of these metals, members of synthetic resins such as polycarbonate and the like, glass, ceramics and papers which have been applied with electroconductive treatment to their surface.

The substrate may be of any configuration, which can be properly determined depending upon the application uses. However, in the case where the formation of the light receiving layer is conducted in a manner in which discharge is caused in the discharge space circumscribed by a plurality of substrates on each of which a film is to be formed, each substrate is desired to be cylindrical. In this case, there is no particular restriction for the size for the cylindrical substrate. However in a preferred embodiment in terms of practical applications, the cylindrical substrate is made to be of a size of 20 mm to 500 mm in diameter and 10 mm to 1000 mm in length.

In the above film-forming manner in which the discharge space is circumscribed by a plurality of cylindrical substrates, the cylindrical substrates are desired to be spacedly arranged while leaving a desired spacing of 1 mm to 50 mm between each adjacent cylindrical substrates. There is no particular restriction for the number of the cylindrical substrates arranged as long as they can establish a desired discharge space circumscribed by them. However, in general, the number of the cylindrical substrates arranged is at least 3, preferably 5 or more.

In the present invention, as particularly desirable examples of the silicon-containing non-single crystal material constituting the above layer, there can be mentioned amorphous materials each containing silicon atoms as a matrix and at least hydrogen atoms, and other amorphous materials each containing silicon atoms as a matrix and other appropriate atoms.

In the electrophotographic photosensitive member of the present invention, the total layer thickness on the substrate is desired to be preferably in the range of 5 μm to 100 μm, more preferably in the range of 10 μm to 70 μm, most preferably in the range of 15 μm to 50 μm.

The formation of the light receiving layer of the electrophotographic photosensitive member may be desirably conducted by means of the plasma CVD technique. The plasma CVD technique herein can include DC glow discharge decomposition process, RF glow discharge decomposition process, and microwave glow discharge decomposition process. Of these processes, the microwave glow discharge decomposition process is the most desirable.

Figure 2:
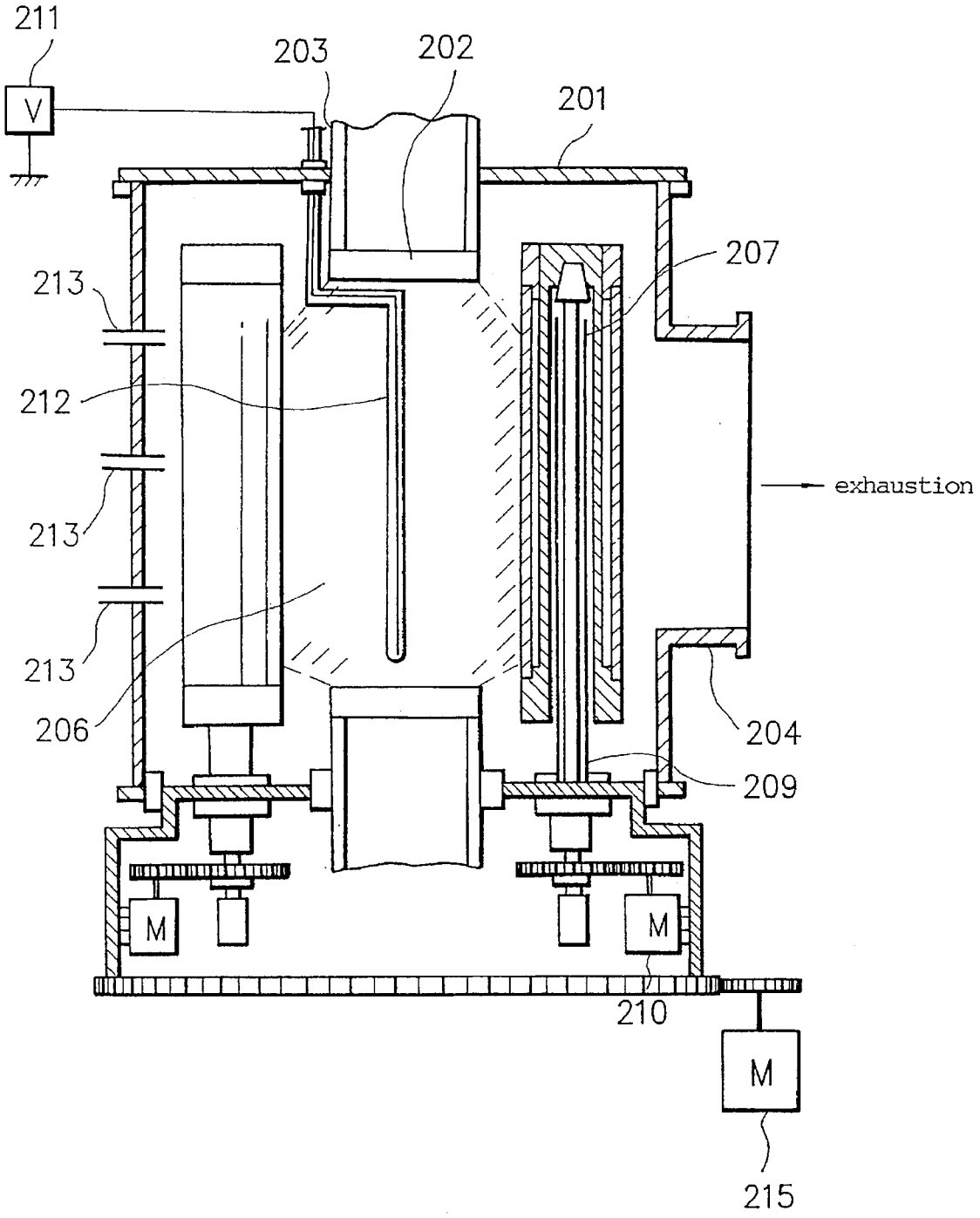
FIGS. 2(A) and 2(B) are schematic diagrams illustrating a film-forming apparatus suitable for the production of an electrophotographic photosensitive member according to the present invention.
Figure 2:
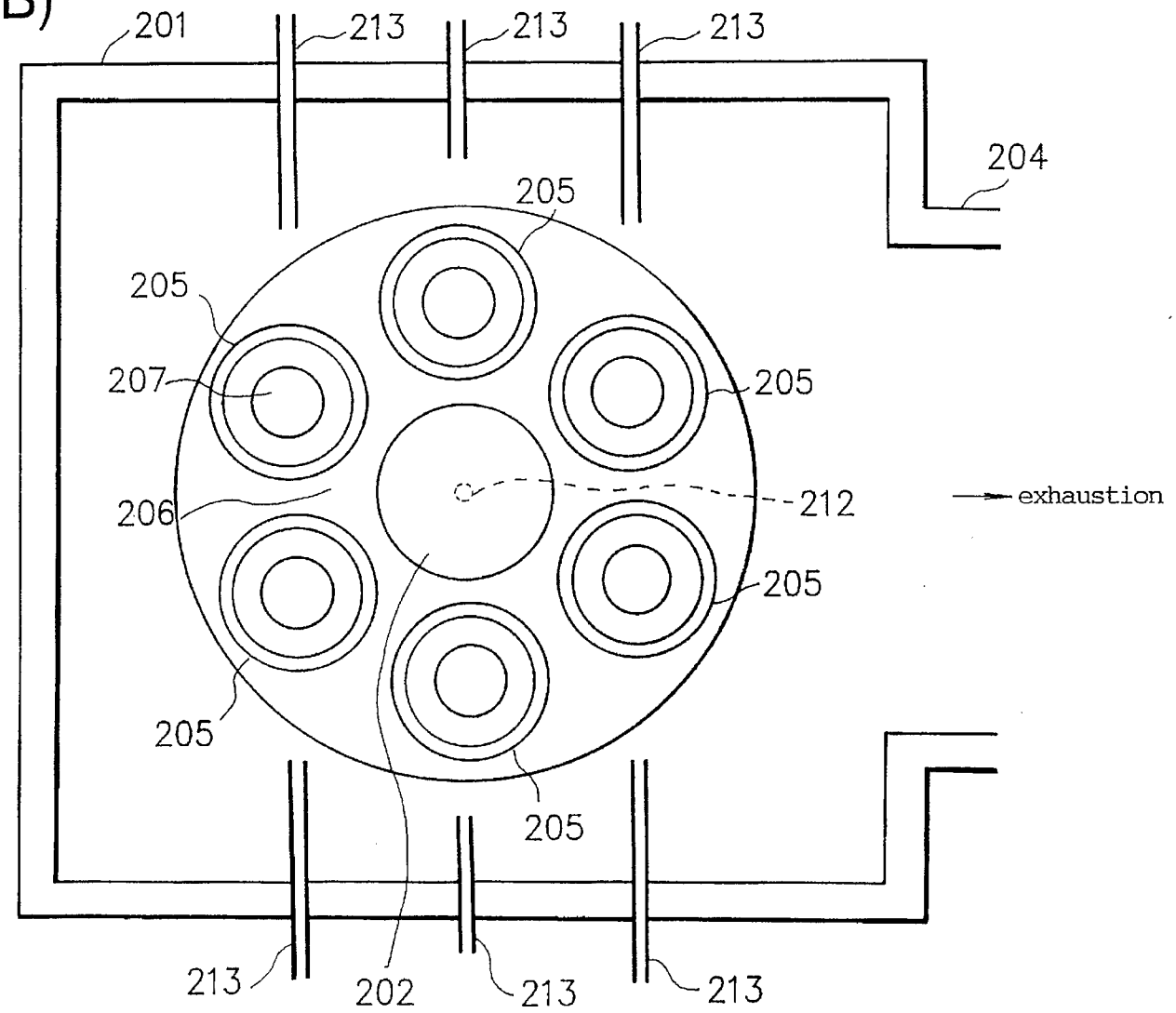
Figure 3:
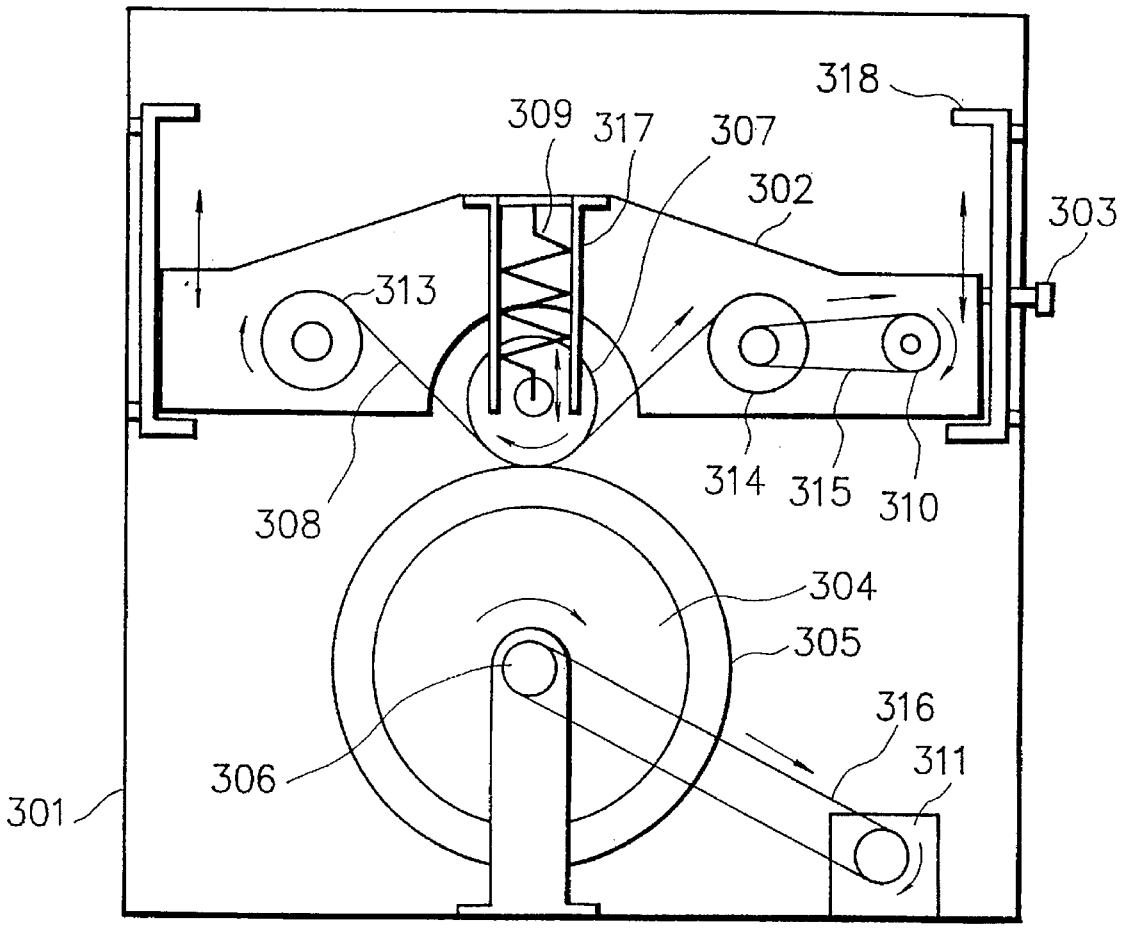
FIG. 3 and FIG. 4 are schematic diagrams each illustrating a polishing apparatus used in the present invention.

In the case of the microwave discharge decomposition process, as shown in FIGS. 2(A) and 2(B), a plurality of substrates are arranged so as to establish a discharge space and a microwave energy is introduced into the discharge space at lest from one end side of the arrangement of the substrates. In this case, the microwave energy is introduced through the microwave introducing dielectric window. The dielectric window is constituted by a dielectric material capable of allowing a microwave energy to transmit therethrough without being leaked such as alumina ($Al_2O_3$), aluminum nitride (AlN), boron nitride (BN), silicon nitride (SIN), silicon carbide (SIC), silicon oxide ($SiO_2$), beryllium oxide (BeO), Teflon, and polystyrene.

The gas pressure in the discharge space upon film formation by using either a D.C. power or RF power as the discharging power is desired to be preferably in the range of 100 mTorr to 5 Torr, more preferably in the range of 200 mTorr to 2 Torr. In the case of conducting the film formation by using a microwave power as the discharging power, it is desired to be preferably in the range of 0.5 mTorr to 100 mTorr, more preferably in the range of 1 mTorr to 50 mTorr in order to attain stable discharging and to ensure a desirable uniformity for a film formed.

As for the substrate temperature upon film formation, a temperature in the range of 100° C. to 500° C. may be employed. However in practice, it is preferably in the range of 150° C. to 450° C., more preferably in the range of 200° C. to 400° C., most preferably in the range of 230° C. to 350° C.

The substrate may be heated to a desired temperature by means of a conventional heating means. Specific examples of such heating means are electric resistance heat generating means such as sheath-like heater, spiral heater, plate-like heater, and ceramics heater, heat radiation lamp heating means such as halogen lamp, and infrared ray lamp, and heat exchanging mechanisms in which liquid or air is used as a heat transfer medium.-In any case, the heating means is designed to have a surface composed of a metal such stainless steel, nickel, aluminum, or copper, or other material such as ceramic, or heat resistant resin.

Instead of the above heating means, it is possible to take a manner in which the substrate is heated in an independent heating vessel situated separately from the reaction chamber and it is transferred into the reaction chamber under vacuum condition. Alternatively, in the case of using a microwave energy for the film formation, it is possible to control the substrate temperature by virtue of the energy from the microwave energy, wherein for instance, the intensity of the microwave applied is properly controlled.

These heating means and manners may be used either singly or in combination of two or more of them.

As for the discharging power upon film formation in the case of using either a D.C. power or RF power, it is preferably in the range of 20 W to 2 kW, more preferably in the range of 50 W to 1 kW. In the case of using a microwave power, it is preferably in the range of 100 W to 10 kW, more preferably in the range of 500 W to 2 kW.

In the present invention, the foregoing surface polishing treatment may be employed if necessary, wherein the use of an abrasive tape applied with fine particles of an abrasive to the surface thereof is particularly effective. Specific examples of the abrasive are silica ($SiO_2$), alumina ($Al_2O_3$), iron oxide ($Fe_2O_3$), silicon carbide (SIC), carbon nitride ($C_3N_4$), and cerium oxide (CeO), respectively in the fine particle powdery form. As for the abrasive used, a due care should be made about its mean particle size, because if the abrasive is of a excessively small mean particle size, a problem entails in that it is difficult to attain a high polishing rate and because of this, it takes a relatively long period of time to complete the surface polishing treatment, and if the abrasive is of an excessively large mean particle size, a problem entails in that the polishing rate is markedly heightened to provide a polishing influence to other portions than the protrusions from the columnar structure regions. In view of this, the abrasive is desired to be of a mean particle size in the range of 1 μm to 20 μm.

The above abrasive tape comprises a film-like base member applied with fine particles of any of the foregoing abrasives to the surface thereof. Specific examples of such film-like base member are thin films of high polymeric organic substances such as polyamide, polyester, polyurethane, polyurea, polyolefin, polystyrene, polyvinyl chloride, polyvinylidene chloride, polyethylene, fluoride, polyacrylonitrile, polyvinyl alcohol, and polyvinylidene cyanide; thin films of metals such a stainless steel, and the like; and papers. Among these, the high polymeric organic substance films are the most desirable for the reasons that they are lightweight, have strength, and resistant to environmental variation, and in addition, they can be mass-produced.

In the surface polishing treatment, the foregoing polishing apparatus may be used. The pressure roller used in the polishing apparatus may be composed of an appropriate material. However, in the case where the pressure roller is excessively hard, there is a tendency that the surface of an electrophotographic photosensitive member as an object to be treated is excessively ground by the abrasive tape and as a result, it is damaged. On the other hand, in the case where the pressure roller is excessively soft, the abrasive tape is not sufficiently pressed against the surface of the photosensitive member to be treated and because of this, a desirable polishing rate is hardly attained. In order to prevent occurrence of these problems, the pressure roller is desired to be one having a coat composed an elastic material such as silicon rubber or urethane rubber. In addition, it is desired for the pressure roller to be such that enables to establish a relevant nip width between the abrasive tape and the photosensitive member to be treated depending upon the magnitude of the pressure applied. The nip width herein is desired to be in the range of 0.01 mm to 3 mm. The pressure applied to the abrasive tape upon the surface polishing treatment is desired to be in the range of 10 g/cm to 500 g/cm in terms of linear pressure.

Alternatively, instead of the above pressure roller, it is possible to use a curved pressure member having a convex surface.

In the present invention, instead of the above described abrasive, it is possible to use a dispersion comprising an abrasive material dispersed in a solvent as the abrasive is effective. The abrasive material usable in this case can include silica ($SiO_2$), alumina ($Al_2O_3$), iron oxide ($Fe_2O_3$), silicon carbide (SIC), carbon nitride ($C_3N_4$), and cerium oxide (CeO), respectively in the fine particle powdery form. As for the abrasive material used, a due care should be made about its mean particle size, because if the abrasive material is of a excessively small mean particle size, a problem entails in that it is difficult to attain a high polishing rate and because of this, it takes a relatively long period of time to complete the surface polishing treatment, and if the abrasive material is of an excessively large mean particle size, a problem entails in that the polishing rate is markedly heightened to provide a polishing influence to other portions than the protrusions from the columnar structure regions of the photosensitive member to be treated. In view of this, the abrasive material is desired to be of a mean particle size in the range of 1 μm to 20 μm.

As the above solvent, it is possible to use any of the conventional solvents as long as the above abrasive material can be dispersed therein as desired. However, in view of ease in handling, water is the most appropriate. As for the content of the abrasive material in the dispersion, it is desired to be in the range of 5% to 50% in terms of volume percentage.

The dispersion comprising any of the above abrasive material dispersed in a given solvent is supported on an appropriate support member. As such support member, any support member may be used in this case as long as it is capable of supporting the suspension thereon. Specific examples are fibrous materials such as fabrics and papers. As for the shape of the support member, there is no particular restriction. Specifically, it may be configured to be in the form of a roller-like shape, a plane shape or other shape having a curved face capable of encapsulating an electrophotographic photosensitive member in the form of a cylindrical shape. In the surface polishing treatment using such abrasive member, the nip width is desired to be in the range of 0.1 mm to 100 mm. The pressure applied to the abrasive member upon the surface polishing treatment is desired to be in the range of 1 $g/cm^2$ to 1000 $g/cm^2$.

In any case, the electrophotographic photosensitive member to be subjected to surface polishing treatment is rotated at a rotation speed of 1 mm/sec. to 1000 mm/sec. And the period of time during which the electrophotographic photosensitive member is subjected to surface polishing treatment is desired to be preferably a period of 10 seconds to 60 minutes, more preferably a period of 1 minute to 10 minutes.

In the present invention, observation of the cross section structure of a deposited film formed as the light receiving layer can be conducted by cutting the deposited film to obtain a sample having a cross section face, if necessary, polishing the cross section face by a conventional buffing technique, and observing the cross section face by means of a conventional optical microscope or electron microscope.

In the following, the electrophotographic photosensitive member and the process for the production thereof according to the present invention will be described in more detail with reference to examples. It should be understood that the scope of the present invention is not restricted to these examples only.

EXAMPLE 1

There were prepared plural kinds of amorphous silicon series three-layered electrophotographic photosensitive members each having the configuration shown in FIG. 1(A) using the same film-forming apparatus as used in Experiment 4. As for each electrophotographic photosensitive member, a plurality of electrophotographic photosensitive member samples were prepared by repeating the film-forming procedures under the conditions shown in Table 1 in Experiment 4, except that the flow rate of the $CH_4$ gas upon forming the layer 104 was varied in each case and the step of spreading the Si-power was conducted by introducing Si-powder of 10 μm in mean particle size together with Ar gas into the reaction chamber 201 through the supply ports 213 for 2 minutes under conditions of $2.5\times10^4$ Pa for the spouting pressure of the Si powder and 1000 sccm for the flow rate of the Ar gas.

As for each of the resultant electrophotographic photosensitive members, evaluation was conducted in the same manner as in Experiment 4.

The evaluated results obtained are collectively shown in Table 4.

The evaluation with respect to appearance of while spots described in Table 4 was conducted in the following manner.

Evaluation of White Spot Appearance:

Image formation is conducted using a solid black original to reproduce image samples. The resultant image samples are evaluated by counting the number of white spots in a given area. Of the image samples, the worst one is shown in the table based on the following criteria.

⊙: presence of no distinguishable white spot,

○: presence of a few distinguishable small white spots,

Δ: presence of a number of white spots on the entire area but practically acceptable, and X: presence of remarkable white spots and practically problematic.

From the results shown in Table 4, it is understood that the electrophotographic photosensitive members belonging to the present invention in which the amount of carbon atoms contained in the layer 104 is in the range of 2.0 atomic % to 25 atomic % excel in the electrophotographic characteristics.

EXAMPLE 2

There were prepared plural kinds of amorphous silicon series three-layered electrophotographic photosensitive members each having the configuration shown in FIG. 1(A) using the same film-forming apparatus as used in Experiment 4. As for each electrophotographic photosensitive member, a plurality of electrophotographic photosensitive member samples were prepared by repeating the film-forming procedures under the conditions shown in Table 1 in Experiment 4, except that the flow rate of the $SiF_4$ gas upon forming the layer 104 was varied in each case and the step of spreading the Si powder was conducted by introducing Si powder of 10 μm in mean particle size together with Ar gas into the reaction chamber 201 through the supply ports 213 for 2 minutes under conditions of $2.5\times10^4$ Pa for the spouting pressure of the Si-powder and 1000 sccm for the flow rate of the Ar gas.

As for each of the resultant electrophotographic photosensitive members, image formation was conducted and evaluated was conducted with respect to photosensitivity evenness and resolution in the same manner as in Experiment 4.

The evaluated results obtained are collectively shown in Table 5.

From the results shown in Table 5, it is understood that the electrophotographic photosensitive members belonging to the present invention in which the amount of fluorine atoms contained in the layer 104 is in the range of 2.0 atomic ppm to 90 atomic ppm excel in the electrophotographic characteristics.

Separately, it was found that the same tendency as in the above is provided in the case where the amount of the carbon atoms contained in the layer 104 is properly varied.

EXAMPLE 3

There were prepared plural kinds of three-layered amorphous silicon series electrophotographic photosensitive members each having the configuration shown in FIG. 1(D) by repeating the procedures of Experiment 4 under the conditions shown in Table 6, wherein the electrophotographic photosensitive members were made different from each other by varying the thickness of each of the layer 104(B) and the layer 105 and varying the total layer thickness on the substrate to a value of 20 μm, 30 μm and 40 μm. In each case, upon forming the layer 104(A), $CH_4$ gas and $SiF_4$ gas were introduced into the reaction chamber at respective flow rates capable of making the amount of the carbon atoms contained therein to be 14 atomic % versus the amount of the silicon atoms contained therein and the amount of the fluorine atoms contained therein to be 70 atomic ppm versus the amount of the silicon atoms contained therein, and upon forming the layer 104(B), $CH_4$ gas and $SiF_4$ gas were introduced into the reaction chamber at respective flow rates capable of making the amount of the carbon atoms contained therein to be 7 atomic % versus the amount of the silicon atoms contained therein and the amount of the fluorine atoms contained therein to be 30 atomic ppm versus the amount of the silicon atoms contained therein. And in each case, the step of spreading the nucleuses for growing a plurality of columnar structure regions was conducted after having formed a deposited film as the layer 104(B) at a thickness of 5 μm, in the same manner as in Experiment 4. As for each of the resultants, evaluation was conducted in the same manner as in Experiment 4. The evaluated results obtained are collectively shown in Table 7.

From the results shown in Table 7, it is understood that the electrophotographic photosensitive members belonging to the present invention in which the layer 104 has a thickness of greater than 30% but less than 100% versus the total layer thickness on the substrate excel in the electrophotographic characteristics.

Separately, it was found that the same tendency as in the above is provided in the case where the amount of each of the carbon and fluorine atoms contained in the layer 104 is properly varied.

EXAMPLE 4

The procedures of Experiment 4 were repeated, except that the film-forming conditions were changed to those shown in Table 8 and that the step of spreading the Si-powder was conducted by introducing Si powder of 10 μm in mean particle sized together with Ar gas into the reaction chamber 201 through the supply ports 213 for 2 minutes under conditions of $2.5\times10^4$ Pa for the spouting pressure of the Si powder and 1000 sccm for the flow rate of the Ar gas, to thereby obtain a plurality of electrophotographic photosensitive member samples. The resultant electrophotographic photosensitive member samples were evaluated in the same manner as in Experiment 4. The evaluated results obtained are collectively shown in Table 10. These electrophotographic photosensitive member samples were evaluated also with respect to minute line reproducibility, cleaning suitability, durability, and maintenance load, respectively in the following manner. The evaluated results obtained with respect to these evaluation items are also collectively shown in Table 10.

Minute Line Reproducibility:

Image formation was conducted using an original having minute characters on a white background to reproduce image samples. As for each image sample, evaluation was conducted of whether or not the minute lines of the original are reproduced without being broken as desired, wherein appearance of uneven image was also observed. 0f the image samples, the worst one was shown in the table based on the following criteria.

⊙: excellent in minute line reproduction,

○: slightly broken parts are present,

Δ: a number of broken parts are present but the characters can be distinguished, and X: markedly broken parts are present and some of the characters cannot be distinguished.

Cleaning Suitability:

There were provided three originals, i.e., a solid black original, a halftone original, and a character original. Image formation was repeatedly conducted ten times using each of these originals to obtain image samples. Based on the resultant image samples, cleaning suitability was evaluated as for the electrophotographic photosensitive member sample used, in accordance with the following criteria. The evaluated result obtained was shown in the table.

⊙: excellent in cleaning suitability,

○: a slight cleaning defect is present,

Δ: some stripe-like cleaning defects are present but they are not problematic in practice, and X: remarkable cleaning defects are present.

Durability:

The electrophotographic photosensitive member sample having been subjected to the above evaluations was subjected to 10,000 times continuous copying shots in a conventional electrophotographic copying machine, and thereafter, the electrophotographic photosensitive member was evaluated with respect to each of the foregoing evaluation items based on the following criteria. The evaluated result obtained was shown in the table.

⊙: the results as for all the evaluation items are satisfactory as well as those at the initial stage, ○: the result as for one of the evaluation items is slightly inferior to that at the initial state, Δ: the results as for some of the evaluation items are distinguishably inferior to those at the initial stage, but they are practically acceptable, and X: the results as for all the evaluation items are markedly inferior and they are problematic in practice.

Maintenance Load:

The electrophotographic photosensitive sample was subjected to continuous copying shots in a conventional electrophotographic copying machine until cleaning defects due to occurrence of a damage at the cleaning blade were appeared or papers were not satisfactorily separated because of wear-out failure at the separating pawl. And the number of papers fed therein was compared with that when the periodic maintenance check is usually conducted for the copying machine. The result was evaluated based on the following criteria. The evaluated result obtained was shown in the table.

⊙: the number of papers fed is markedly greater than that when the periodic maintenance check is conducted, ○: the number of papers fed is slightly grater than that when the periodic maintenance check is conducted, Δ: the number of papers fed is smaller than that when the periodic maintenance check is conducted, and X: the number of papers fed is markedly smaller than that when the periodic maintenance check is conducted.

COMPARATIVE EXAMPLE 1

Figure 6:
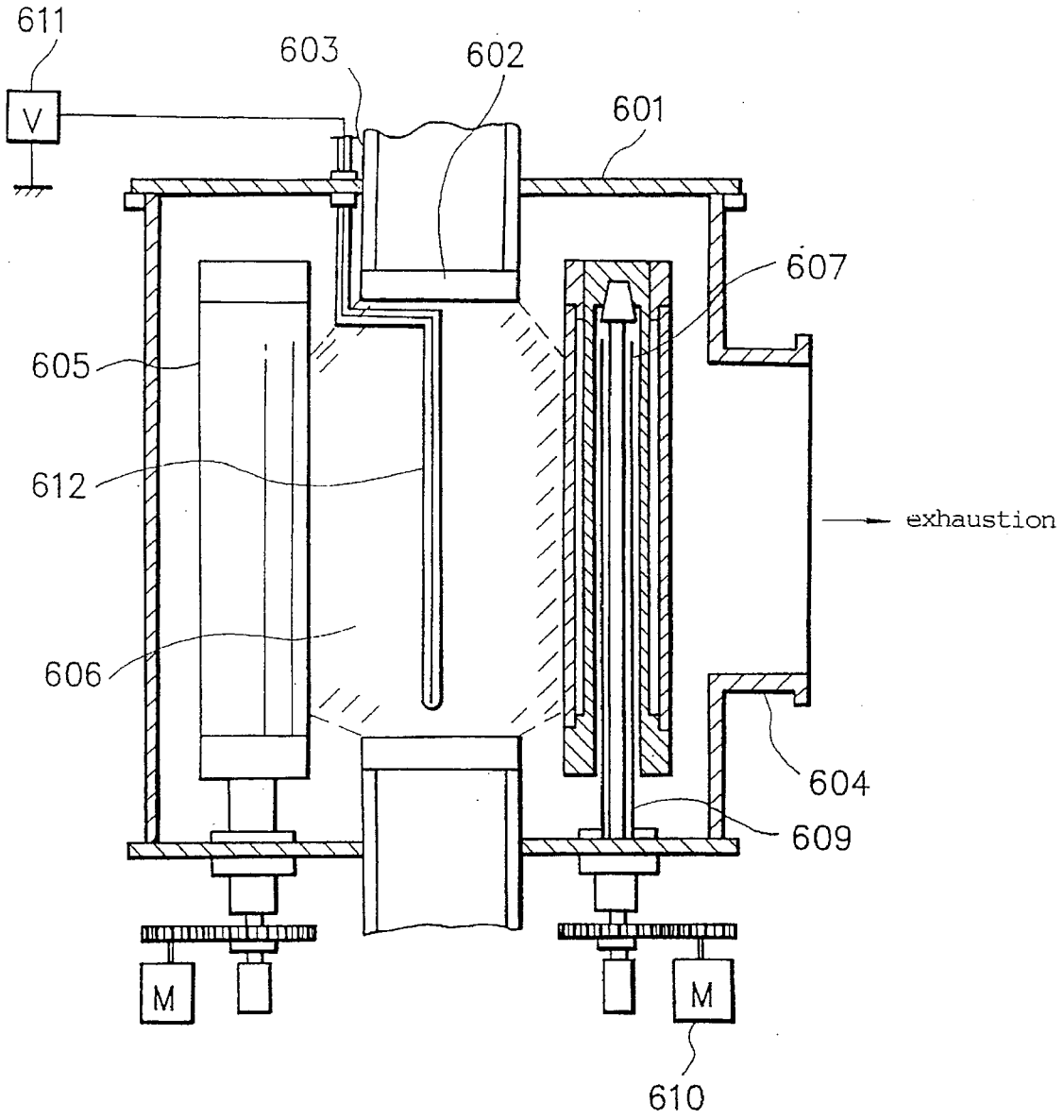
FIGS. 6(A) and 6(B) are schematic diagrams illustrating a microwave plasma CVD apparatus.
Figure 6:
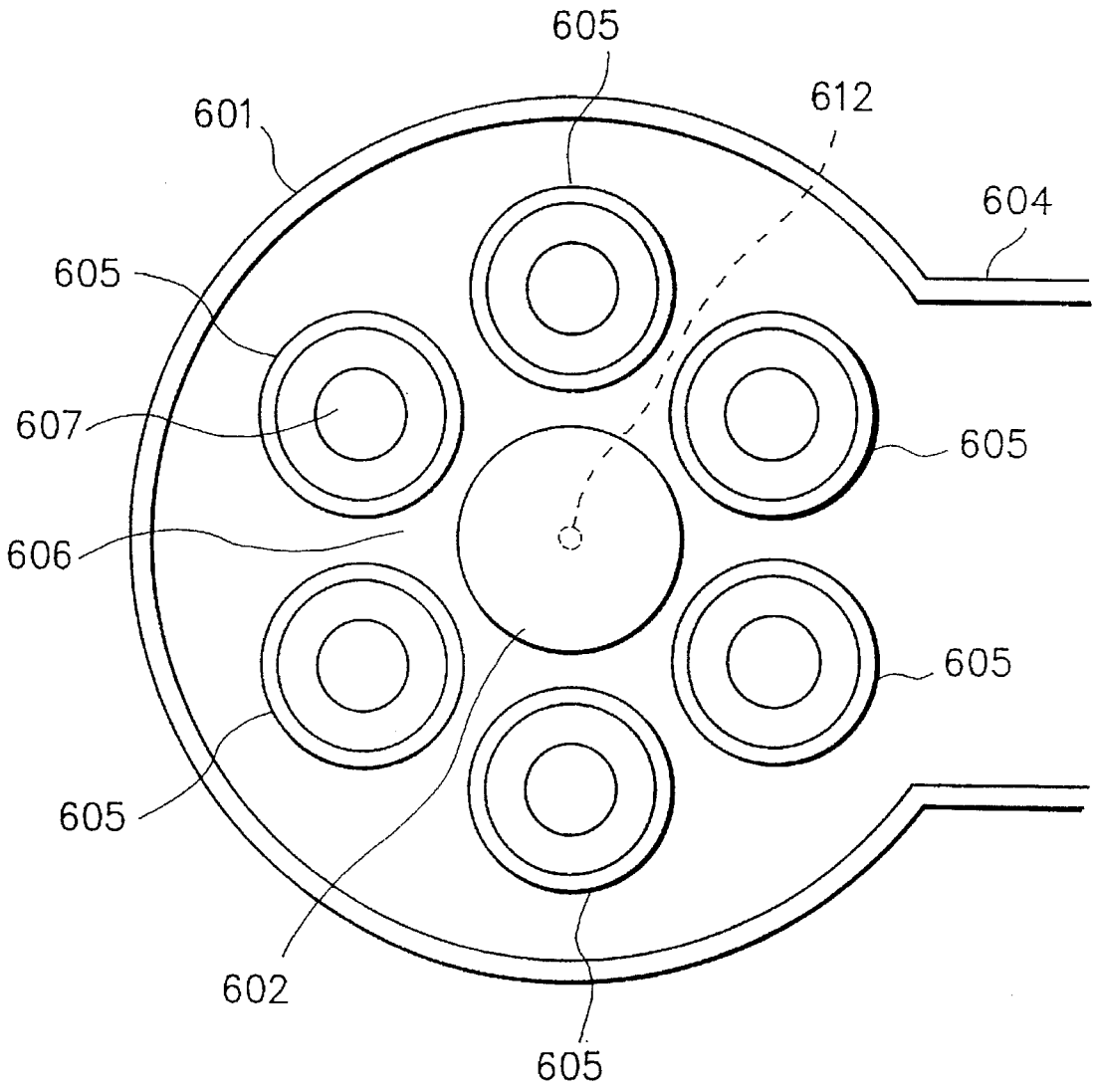

Using the film-forming apparatus shown in FIGS. 6(A) and 6(B), there were prepared a plurality of electrophotographic photosensitive member samples without having any columnar structure regions under the conditions shown in Table 3. The resultant electrophotographic photosensitive member samples were evaluated in the same manner as in Example 4. The evaluated results obtained are collectively shown in Table 10.

COMPARATIVE EXAMPLE 2

Figure 5:
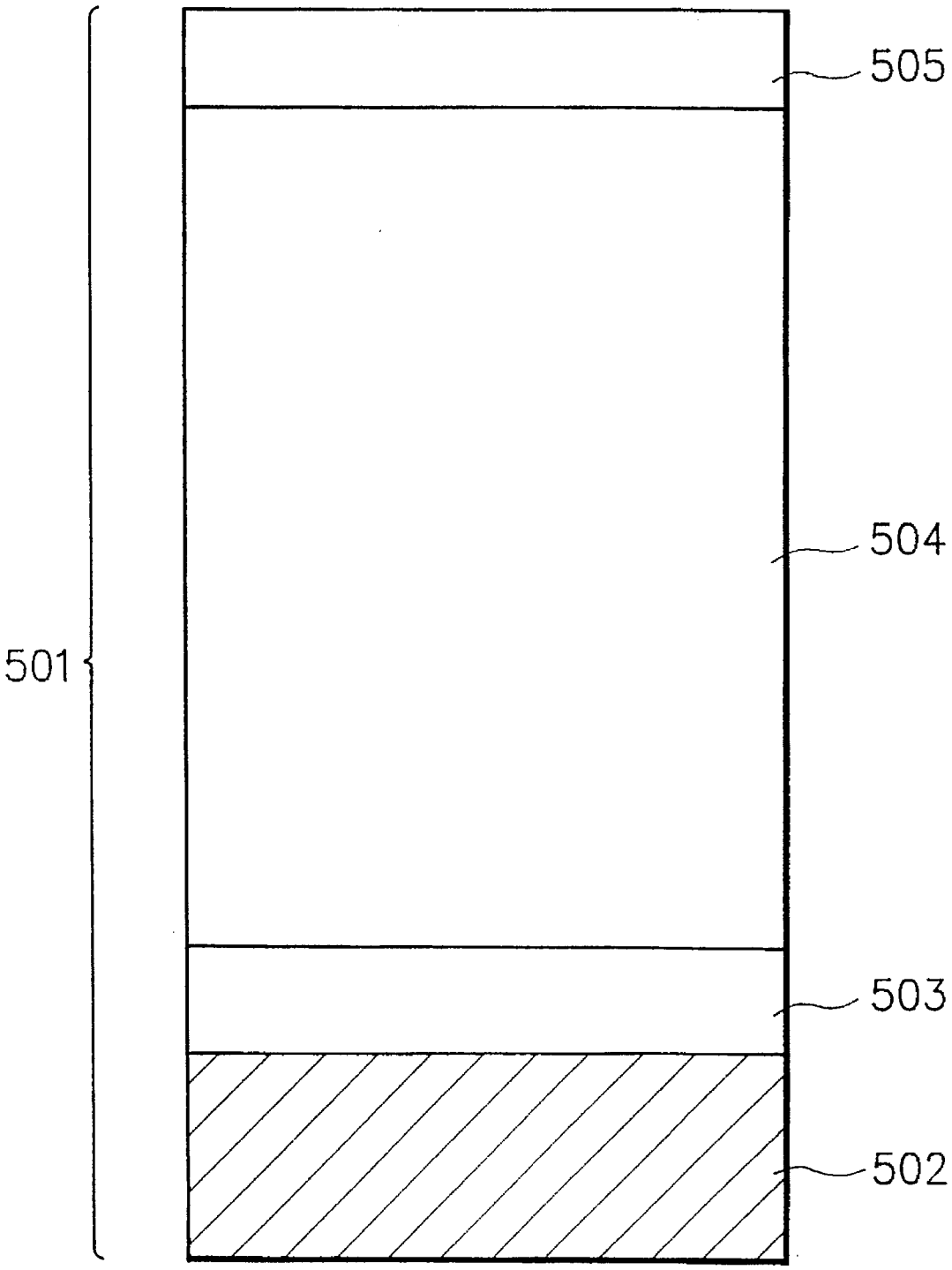
FIG. 5 is a schematic cross sectional view illustrating a conventional electrophotographic photosensitive member.

There were prepared a plurality of amorphous silicon series electrophotographic photosensitive member samples having the configuration shown in FIG. 5 by means of the RF plasma CVD process under the conditions shown in Table 9.

Herein, in FIG. 5, reference numeral 502 indicates an Al substrate, reference numeral 503 indicates a charge injection inhibition layer, reference numeral 504 indicates a photoconductive layer, and reference numeral 505 indicates a surface layer.

Figure 7:
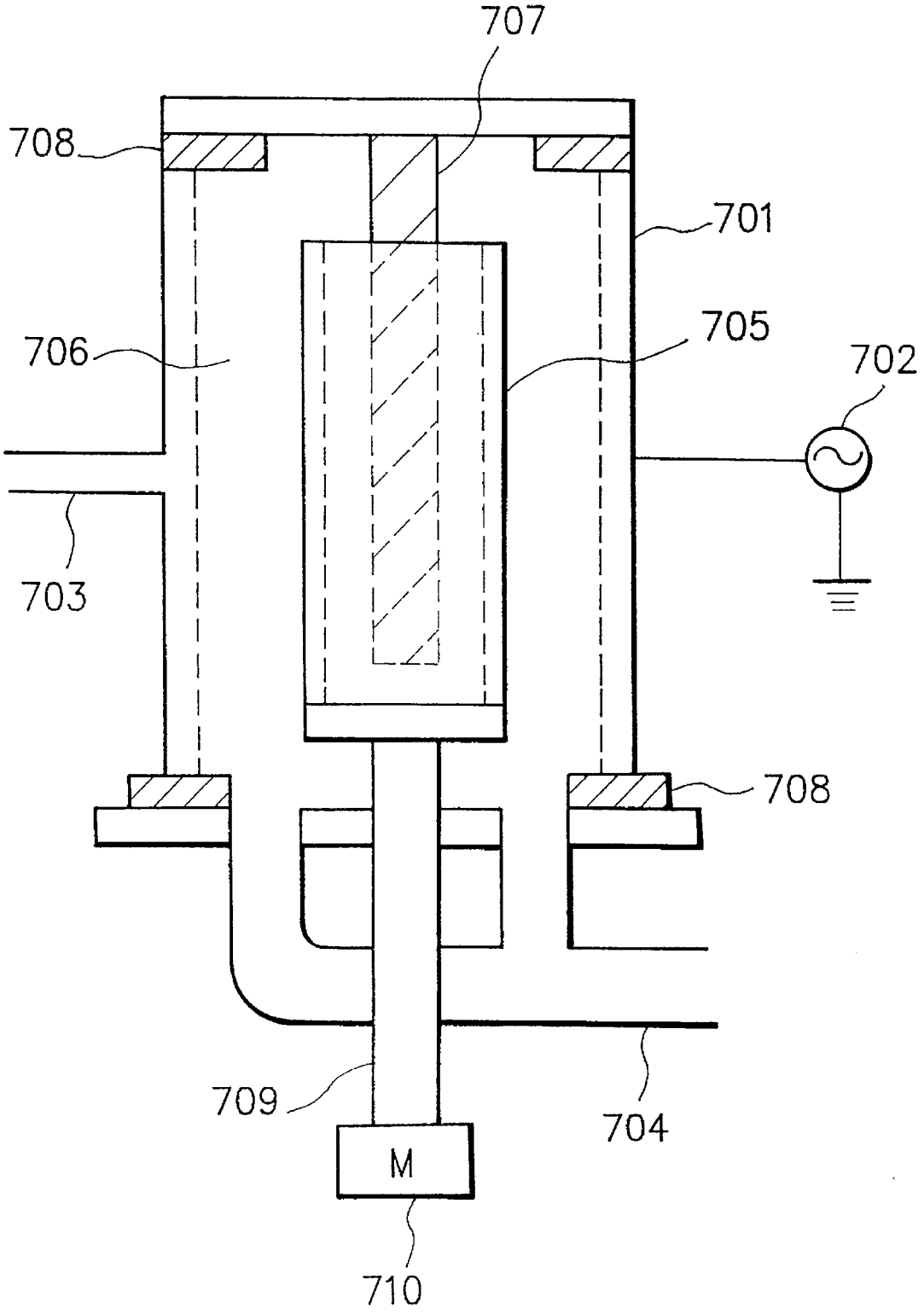
FIG. 7 is a schematic diagram illustrating a RF plasma CVD apparatus.

Each electrophotographic photosensitive member was prepared using a film-forming apparatus of the constitution shown in FIG. 7, wherein the respective amorphous silicon films were formed on the Al substrate 705 in the conventional manner.

In FIG. 7, reference numeral 701 indicates a reaction chamber, reference numeral 702 indicates a RF power source, reference numeral 703 indicates a raw material gas feed pipe, reference numeral 706 indicates a discharge space, reference numeral 707 indicates a holding member, reference numeral 708 indicates an insulator, and reference numeral 709 indicates a rotary shaft.

Figure 8:
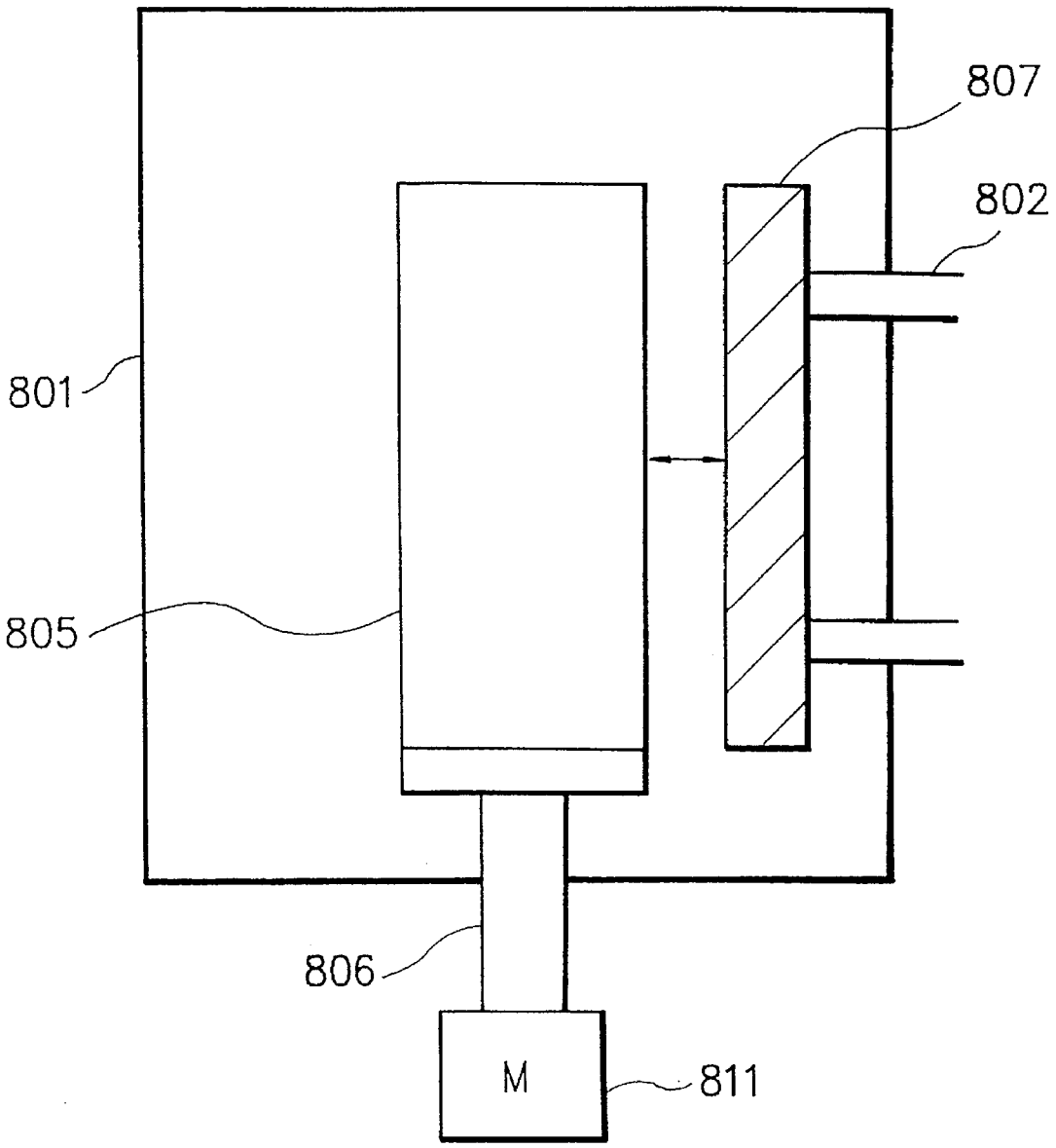
FIG. 8 is a schematic diagram illustrating a polishing apparatus.
Figure 2:
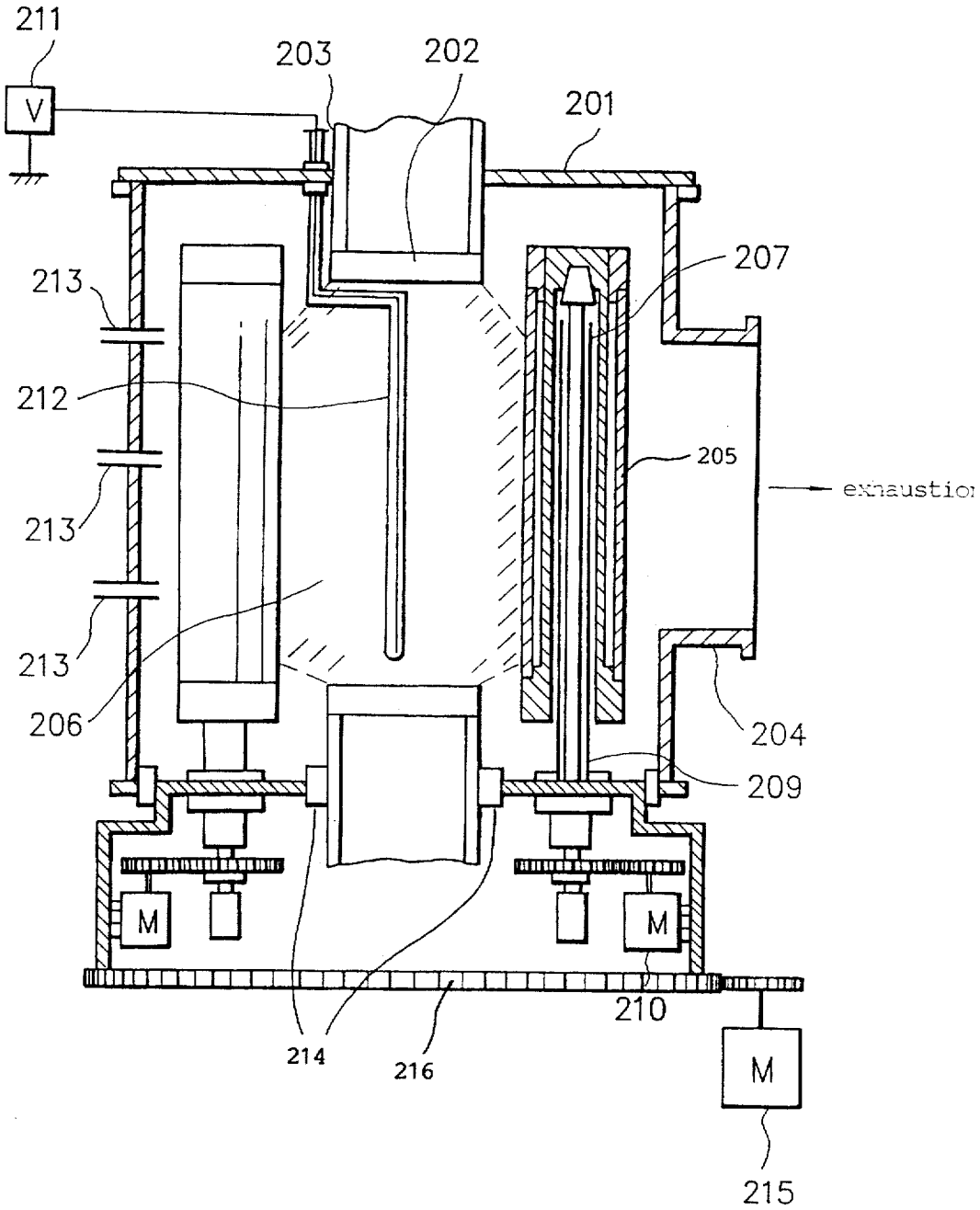

Each of the resultant electrophotographic photosensitive member samples was subjected to surface polishing treatment using a polishing apparatus 801 of the constitution shown in FIG. 8. In the surface polishing treatment using this polishing apparatus, the electrophotographic photosensitive member sample 805 was positioned on rotary shaft 806, and it was rotated by means of motor 811 while press-contacting an abrasive cloth 807 applied with a dispersion of powdery silica of 2 μm in mean particle size dispersed in normal heptane to the surface thereof to the surface of the photosensitive member sample 805 by means of press-contacting mechanism 802, whereby the surface of the photosensitive member sample was polished.

The electrophotographic photosensitive member samples thus treated were evaluated in the same manner as in Example 4. The evaluated results obtained are collectively shown in Table 10.

EXAMPLE 5

Using the same film-forming apparatus as used in Experiment 4, there were prepared a plurality of four-layered electrophotographic photosensitive member samples each having the configuration shown in FIG. 1(E) by repeating the procedures of Experiment 4 under the conditions shown in Table 11, wherein the step of spreading the Si powder as the nucleuses for growing a plurality of columnar structure regions was conducted by introducing, after having formed a deposited film as the layer 104 at a thickness of 5 μm, Si powder of 12 μm in mean particle sized together with Ar gas into the reaction chamber 201 through the supply ports 213 for 2 minutes under conditions of $2.5\times10^4$ Pa for the spouting pressure of the Si powder and 800 sccm for the flow rate of the Ar gas. The resultant electrophotographic photosensitive member samples were evaluated in the same manner as in Example 4. As a result, the electrophotographic photosensitive member samples were found to be excellent in the electrophotographic characteristics as well as the electrophotographic photosensitive member samples obtained in Example 4.

EXAMPLE 6

Using the same film-forming apparatus as used in Experiment 4, there were prepared a plurality of three-layered electrophotographic photosensitive member samples each having the configuration shown in FIG. 1(A) by repeating the procedures of Experiment 4, except that the film-forming conditions were changed to those shown in Table 12 wherein acetylene gas was used instead of the methane gas as the carbon atom-supplying source upon forming the layer 104 and that the step of spreading the Si powder as the nucleuses for growing a plurality of columnar structure regions was conducted by introducing, after having formed a deposited film as the layer 104 at a thickness of 4 μm, Si powder of 12 μm in mean particle sized together with Ar gas into the reaction chamber 201 through the supply ports 213 for 3 minutes under conditions of $2.5\times10^4$ Pa for the spouting pressure of the Si powder and 800 sccm for the flow rate of the Ar gas. The resultant electrophotographic photosensitive member samples were evaluated in the same manner as in Example 4. As a result, the electrophotographic photosensitive member samples were found to be excellent in the electrophotographic characteristics as well as the electrophotographic photosensitive member samples obtained in Example 4.

EXAMPLE 7

Using the film-forming apparatus, the procedures of Example 4 were repeated under the film-forming conditions shown in Table 8 to thereby obtained a plurality of electrophotographic photosensitive member samples.

Figure 4:
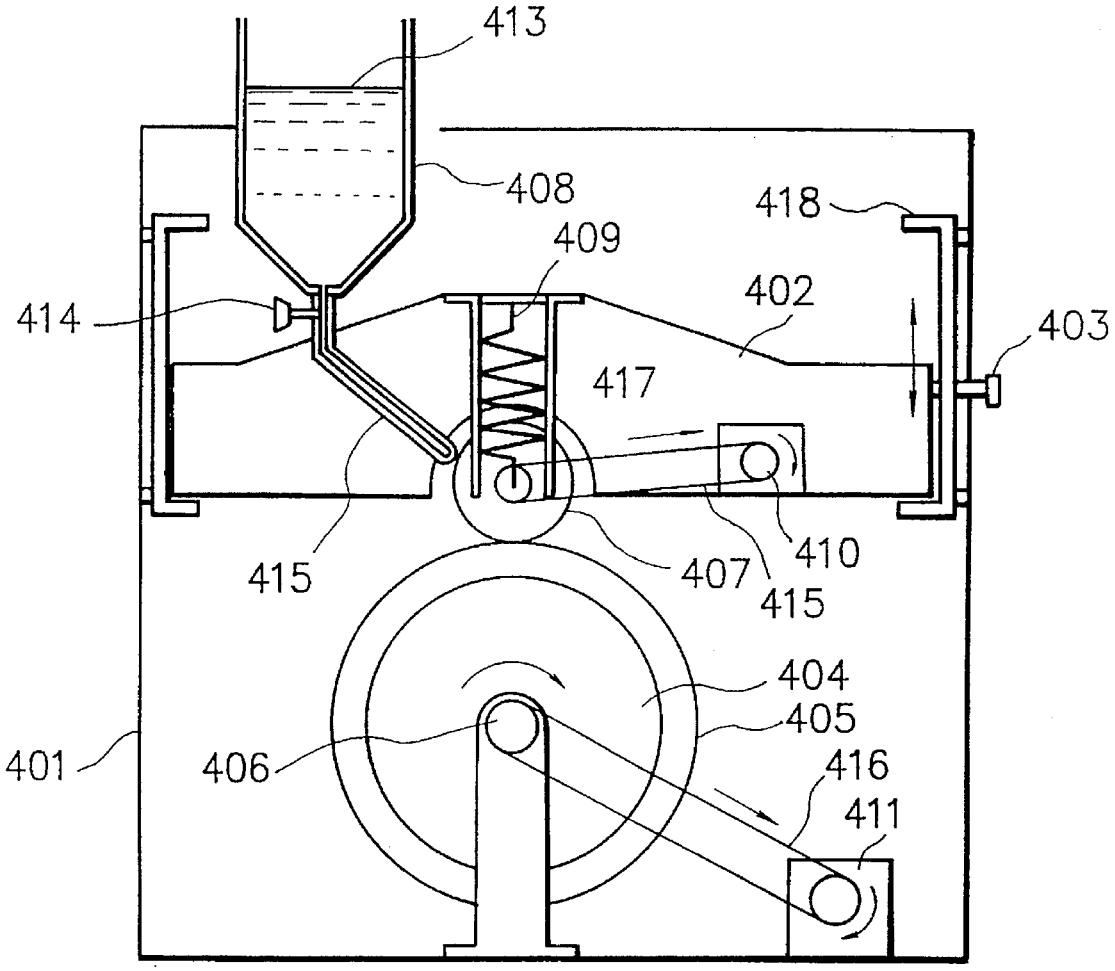

Each of the resultant electrophotographic photosensitive member samples was subjected to surface treatment using a polishing apparatus of the constitution shown in FIG. 4. The polishing apparatus shown in FIG. 4 is of the type that an electrophotographic photosensitive member to be treated is set to a rotary shaft the rotary shaft is rotated while supplying an abrasive liquid 413 to the surface of the electrophotographic photosensitive member on the rotary shaft, whereby the surface of the electrophotographic photosensitive member is polished.

The above surface treatment of the electrophotographic photosensitive member was conducted in the following manner. That is, a polishing unit 402 in the polishing apparatus body 401 was lifted upward and it was secured by a clamp 403. Then, the electrophotographic photosensitive member sample 405 was assembled with a supporting table 404 and the assembly was fixed to the rotary shaft 406. The clamp 403 was then loosed to lower the polishing unit 402, whereby a polishing roller 407 having a fabric disposed on the exterior surface thereof was press-contacted through the fabric to the surface of the electrophotographic photosensitive member 405 at a pressure of 10 g/cm$^2$ and a nip width of 10 mm by means of a pressure controlling spring 409. An abrasive dispersion 413 containing silicon carbide particles of 8 μm on mean particle size stored in a container 408 was dropwise supplied through an injection pipe 415 onto the polishing roller 407 while controlling the flow rate thereof by means of a valve 414. Simultaneously with the supply of the abrasive dispersion, motors 410 and 411 started driving, whereby the surface treatment of the electrophotographic photosensitive member sample was conducted. In this case, the polishing roller 407 was rotated at a speed of 10 mm/minute, and the electrophotographic photosensitive member sample 405 was rotated at a speed of 300 mm/sec. This surface treatment was conducted for 5 minutes. The electrophotographic photosensitive member sample thus treated was washed with ion-exchanged water to remove the abrasive dispersion left on the surface thereof. The resultant was transferred into a drying vessel, wherein it was dried at 40° C. for an hour to thereby dewater.

The resultant electrophotographic photosensitive member samples were evaluated in the same manner as in Example 4. As a result, the electrophotographic photosensitive member samples were found to be excellent in the electrophotographic characteristics as well as the electrophotographic photosensitive member samples obtained in Example 4.

In tables 2, 4, 5, 7 and 10, the results of evaluations of electrophotographic photosensitive members are provided in which the definitions and symbols for photosensitivity evenness; resolution; appearance of interference fringe pattern; appearance of coarseness; white spot appearance; minute line reproducibility; durability; maintenance load and cleaning suitability are as previously recited herein.

TABLE 1

| film-forming | constituent layer | | |
|---|---|---|---|
| conditions | 103 | 104 | 105 |
| raw material gas and flow rate | | | |
| $SiH_4$ | 350 sccm | 350 sccm | 70 sccm |
| He | 100 sccm | 100 sccm | 100 sccm |
| $B_2H_6$ | 1000 ppm | 0 ppm | 0 ppm |
| NO | 10 sccm | 0 sccm | 0 sccm |
| $CH_4$ | 0 sccm | 50 sccm | 350 sccm |
| $SiF_4$ | 0 sccm | 1 sccm | 0 sccm |
| substrate temperature | 250° C. | 250° C. | 250° C. |
| inner pressure | 4.0 mTorr | 4.0 mTorr | 4.0 mTorr |
| microwave power | 1000 W | 1000 W | 1000 W |
| bias voltage | 70 V | 70 V | 70 V |
| layer thickness | 3 μm | 20 μm | 0.5 μm |

TABLE 2

| columnar structure region density (number/$cm_2$) | photo-sensitivity evenness | reso-lution | appearance of inter-ference fringe pattern | appearnace of coarseness |
|---|---|---|---|---|
| 0.5 | x | x | x | ◎ |
| 1 | Δ | Δ | Δ | ◎ |
| 2 | Δ | Δ | Δ | ◎ |
| 5 | ○ | ○ | ○ | ◎ |
| 10 | ◎ | ◎ | ◎ | ◎ |
| 100 | ◎ | ◎ | ◎ | ◎ |
| 200 | ◎ | ○ | ◎ | ○ |
| 300 | ◎ | ○ | ◎ | ○ |
| 500 | ○ | ○ | ◎ | ○ |
| 1000 | ○ | Δ | ◎ | Δ |
| 1500 | Δ | x | ○ | x |

TABLE 3

| film-forming conditions | constituent layer 503 | 504 | 505 |
|---|---|---|---|
| raw material gas and flow rate | | | |
| $SiH_4$ | 350 sccm | 350 sccm | 70 sccm |
| He | 100 sccm | 100 sccm | 100 sccm |
| $B_2H_6$ | 1000 ppm | 0 ppm | 0 ppm |
| NO | 10 sccm | 0 sccm | 0 sccm |
| $CH_4$ | 0 sccm | 50 sccm | 350 sccm |
| $SiF_4$ | 0 sccm | 0 sccm | 0 sccm |
| substrate temperature | 250° C. | 250° C. | 250° C. |
| inner pressure | 4.0 mTorr | 4.0 mTorr | 4.0 mTorr |
| microwave power | 1000 W | 1000 W | 1000 W |
| bias voltage | 70 V | 70 V | 70 V |
| layer thickness | 3 μm | 20 μm | 0.5 μm |

TABLE 4

| carbon content (atomic %) | photo-sensitivity evenness | resolution | appearance of inter-ference fringe pattern | appearance of white-spot |
|---|---|---|---|---|
| 0 | Δ | Δ | ○ | Δ |
| 0.5 | Δ | Δ | ○ | Δ |
| 1.0 | ○ | ○ | ○ | Δ |
| 1.5 | ○ | ○ | ○ | Δ |
| 2.0 | ○ | ○ | ◎ | ○ |
| 2.5 | ○ | ○ | ◎ | ○ |
| 3.0 | ◎ | ◎ | ◎ | ◎ |
| 10 | ◎ | ◎ | ◎ | ◎ |
| 20 | ◎ | ◎ | ◎ | ◎ |
| 23 | ○ | ○ | ◎ | ◎ |
| 25 | ○ | ○ | ◎ | ◎ |
| 28 | Δ | Δ | ◎ | ○ |
| 30 | Δ | Δ | ◎ | ○ |
| 33 | x | x | ○ | Δ |

TABLE 5

| fluorine content (atomic ppm) | photo-sensitivity evenness | resolution |
|---|---|---|
| 0 | Δ | Δ |
| 0.5 | Δ | Δ |
| 1.0 | ○ | Δ |
| 1.5 | ○ | Δ |
| 2.0 | ○ | ○ |
| 2.5 | ○ | ○ |
| 3.0 | ◎ | ◎ |
| 50 | ◎ | ◎ |
| 80 | ◎ | ◎ |
| 87 | ◎ | ○ |
| 90 | ◎ | ○ |
| 93 | ○ | Δ |
| 95 | ○ | Δ |
| 100 | Δ | x |

TABLE 6

| film-forming conditions | constituent layer 104(A) | 104(B) | 105 |
|---|---|---|---|
| raw material gas and flow rate | | | |
| $SiH_4$ | 350 sccm | 350 sccm | 350 sccm |
| He | 100 sccm | 100 sccm | 100 sccm |
| $B_2H_6$ | 1000 ppm | 0 ppm | 0 ppm |
| $CH_4$ | * | * | 0 sccm |
| $SiF_4$ | * | * | 0 sccm |
| substrate temperature | 250° C. | 250° C. | 250° C. |
| inner pressure | 4.0 mTorr | 4.0 mTorr | 4.0 mTorr |
| microwave power | 1000 W | 1000 W | 1000 W |
| bias voltage | 70 V | 70 V | 70 V |
| layer thickness | 1 μm | * | * |

*disclosed in the description

TABLE 7

| thickness of the layer 104 (μm) | total layer thickness (μm) 20 photo-sensitivity evenness | 20 appearance of white-spot | 30 photo-sensitivity evenness | 30 appearance of white-spot | 40 photo-sensitivity evenness | 40 appearance of white-spot |
|---|---|---|---|---|---|---|
| 5 | ○ | Δ | ○ | Δ | ○ | Δ |
| 6 | ○ | ○ | ○ | Δ | ○ | Δ |
| 9 | ○ | ○ | ○ | ○ | ○ | Δ |
| 10 | ⊙ | ⊙ | ○ | ○ | ○ | Δ |
| 12 | ⊙ | ⊙ | ○ | ○ | ○ | ○ |
| 15 | ⊙ | ⊙ | ⊙ | ⊙ | ○ | ○ |
| 20 | ⊙ | ⊙ | ⊙ | ⊙ | ⊙ | ⊙ |
| 30 | — | — | ⊙ | ⊙ | ⊙ | ⊙ |
| 40 | — | — | — | — | ⊙ | ⊙ |

TABLE 8

| film-forming conditions | constituent layer 103 | 104 | 105 |
|---|---|---|---|
| raw material gas and flow rate | | | |
| $SiH_4$ | 350 sccm | 350 sccm | 70 sccm |
| He | 100 sccm | 100 sccm | 100 sccm |
| $B_2H_6$ | 1000 ppm | 0 ppm | 0 ppm |
| NO | 10 sccm | 0 sccm | 0 sccm |
| $CH_4$ | 0 sccm | 50 sccm | 350 sccm |
| $SiF_4$ | 0 sccm | 1 sccm | 0 sccm |
| substrate temperature | 250° C. | 260° C. | 250° C. |
| inner pressure | 4.0 mTorr | 4.0 mTorr | 4.0 mTorr |
| microwave power | 1000 W | 1000 W | 1000 W |
| bias voltage | 70 V | 70 V | 70 V |
| layer thickness | 3 μm | 20 μm | 0.5 μm |

TABLE 9

| film-forming conditions | constituent layer 503 | 504 | 505 |
|---|---|---|---|
| raw material gas and flow rate | | | |
| $SiH_4$ | 1000 sccm | 2000 sccm | 1000 sccm |
| $B_2H_6$ | 200 ppm | 1.0 ppm | 0 ppm |
| $CH_4$ | 0 sccm | 400 sccm | 4000 sccm |
| substrate temperature | 300° C. | 300° C. | 300° C. |
| inner pressure | 0.5 Torr | 0.5 Torr | 0.5 Torr |
| RF power | 500 W | 1000 W | 500 W |
| layer thickness | 0.5 μm | 48 μm | 2.0 μm |

TABLE 10

| | Example 4 | Comparative Example 1 | Comparative Example 1 |
|---|---|---|---|
| photo-sensitivity evenness | ⊙ | x | x |
| resolution | ⊙ | x | x |
| appearance of interference fringe pattern | ⊙ | x | x |
| appearance of coarseness | ⊙ | ○ | ○ |
| appearance of white-spot | ⊙ | ○ | Δ |
| minute line reproductivity | ⊙ | Δ | Δ |
| cleaning suitability | ⊙ | ○ | ○ |
| durability | ⊙ | Δ | Δ |
| maintenance load | ⊙ | Δ | Δ |

TABLE 11

| film-forming conditions | constituent layer 103 | 104 | 105 (A) | 105 (B) |
|---|---|---|---|---|
| raw material gas and flow rate | | | | |
| $SiH_4$ | 400 sccm | 300 sccm | 300 sccm | 70 sccm |
| He | 2000 sccm | 2000 sccm | 2000 sccm | 2000 sccm |
| $B_2H_6$ | 1000 ppm | 5 ppm | 1 ppm | 0 ppm |

TABLE 11-continued

| film-forming conditions | constituent layer 103 | 104 | 105 (A) | 105 (B) |
|---|---|---|---|---|
| $CH_4$ | 200 sccm | 50 sccm | 0 sccm | 500 sccm |
| $SiF_4$ | 0 sccm | 1 sccm | 0 sccm | 30 sccm |
| substrate temperature | 240° C. | 270° C. | 260° C. | 260° C. |
| inner pressure | 10 mTorr | 10 mTorr | 10 mTorr | 10 mTorr |
| microwave power | 1000 W | 1000 W | 1000 W | 1000 W |
| bias voltage | 100 V | 70 V | 70 V | 70 V |
| layer thickness | 1 μm | 20 μm | 5 μm | 0.5 μm |

TABLE 12

| film-forming conditions | constituent layer 104 (A) | 104 (B) | 105 |
|---|---|---|---|
| raw material gas and flow rate | | | |
| $SiH_4$ | 350 sccm | 350 sccm | 70 sccm |
| He | 100 sccm | 100 sccm | 100 sccm |
| $B_2H_6$ | 1000 ppm | 0 ppm | 0 ppm |
| $CH_4$ | 0 sccm | 0 sccm | 350 sccm |
| $C_2H_2$ | 20 sccm | 20 sccm | 0 sccm |
| $SiF_4$ | 1 sccm | 1 sccm | 0 sccm |
| substrate temperature | 280° C. | 300° C. | 270° C. |
| inner pressure | 4.0 mTorr | 4.0 mTorr | 4.0 mTorr |
| microwave power | 1000 W | 1000 W | 1000 W |
| bias voltage | 70 V | 70 V | 70 V |
| layer thickness | 3 μm | 20 μm | 0.5 μm |

We claim:

1. An electrophotographic photosensitive member comprising a substrate and a light receiving layer disposed on said substrate, said light receiving layer comprising a non-single crystal silicon material a matrix, wherein said light receiving layer contains a plurality of columnar structure regions, each of the columnar structure regions is of a diameter from 1 μm to 300 μm and each is grown from a nucleus comprising a crystal material positioned within said light receiving layer, said plurality of columnar structure regions extending in the direction of thickness and within said light receiving layer, and comprising silicon crystals at a density of $5/cm^2$ to $500/cm^2$ formed in the matrix of said non-single crystal silicon material.

2. An electrophotographic photosensitive member according to claim 1, wherein the nucleus is set at a position which is distant by 1 μm or more from the layer interface of the light receiving layer on the substrate side.

3. An electrophotographic photosensitive member according claim 1, wherein the non-single crystal material by which the light receiving layer is constituted contains carbon atoms in an amount of 2.0 atomic % to 25 atomic % versus the amount of the constituent silicon atoms of the light receiving layer.

4. An electrophotographic photosensitive member according to claim 1, wherein the non-single crystal material by which the light receiving layer is constituted contains fluorine atoms in an amount of 2.0 atomic ppm to 90 atomic ppm versus the amount of the constituent silicon atoms of the light receiving layer.

5. The electrophotographic photosensitive member according to claim 1, wherein the non-single crystal silicon material contains hydrogen atoms.

6. A process for producing an electrophotographic photosensitive member by introducing a gaseous silicon-containing raw material into a substantially enclosed deposition chamber having a discharge space and supplying a microwave energy into said deposition chamber to generate a plasma in said discharge space thereby forming a light receiving layer composed of a non-single crystal silicon material as a matrix on a substrate arranged in said deposition chamber, said process comprising the steps of:

(i) forming a first partial region of said light receiving layer, (ii) spacedly depositing a plurality of nucleuses, each of the nucleuses comprising a crystal material and each capable of being a nucleus for growing a columnar structure region therefrom on the surface of said first partial region in an immobilized state, and (iii) forming a second partial region of said light receiving layer on the surface of said first partial region having said plurality of nucleuses thereon while growing columnar structure regions comprising silicon crystals based on each of said plurality of nucleuses, each of said columnar structure regions being of a diameter from 1 μm to 300 μm, thereby forming said light receiving layer containing a plurality of columnar structure regions comprising silicon crystals at a density of $5/cm^2$ to $500/cm^2$ formed in the matrix of said non-single crystal silicon material, said plurality of columnar structure regions comprising silicon crystals extending in the direction of layer growth.

7. The process for producing an electrophotographic photosensitive member according to claim 6, wherein each of the nucleuses is set at a position which is distant by 1 μm or more from the layer interface of the light receiving layer on the substrate side.

8. The process for producing an electrophotographic photosensitive member according to claim 6, wherein the non-single crystal material by which the light receiving layer is constituted contains carbon atoms in an amount of 2.0 atomic % to 25 atomic % versus the amount of the constituent silicon atoms of the light receiving layer.

9. The process for producing an electrophotographic photosensitive member according to claim 6, wherein the non-single crystal material by which the light receiving layer is constituted contains fluorine atoms in an amount of 2.0 atomic ppm to 90 atomic ppm versus the amount of the constituent silicon atoms of the light receiving layer.

10. The process for producing an electrophotographic photosensitive member according to claim 6, wherein the nucleuses are introduced into the reaction chamber while being electrically charged.

11. The process for producing an electrophotographic photosensitive member according to claim 10, wherein the nucleuses are electrically charged by way of corona charging.

12. The process for producing an electrophotographic photosensitive member according to claim 10, wherein the electrically charged nucleuses are deposited on the surface of the partial layer region by virtue of an electrical field of 1 V/cm to 100 V/cm.

13. The process for producing an electrophotographic photosensitive member according to claim 6, wherein the non-single crystal silicon material contains hydrogen atoms.

* * * * *

UNITED STATES PATENT AND TRADEMARK OFFICE

CERTIFICATE OF CORRECTION

PATENT NO. : 5,624,776

DATED : April 29, 1997

INVENTORS : TETSUYA TAKEI ET AL.

It is certified that error appears in the above-identified patent and that said Letters Patent is hereby corrected as shown below:

IN THE DRAWINGS

Sheet 13 of 15 Fig. 2(A) Add reference numerals --205--; --214-- and --216--, as shown on the attached page.

COLUMN 2

Line 29, "cross section" should read --cross-section--.

COLUMN 3

Line 17, "and" should be deleted;
Line 20, "are still remained" should read --still remain--;
Line 39, "Further" should read --Further,--.

COLUMN 9

Line 20, "loosed" should read --loosened--.

COLUMN 10

Line 40, "each" should be deleted.

COLUMN 13

Line 14, "film as" should read --film was formed as--;
Line 44, "film as" should read --film was formed as--.

UNITED STATES PATENT AND TRADEMARK OFFICE

CERTIFICATE OF CORRECTION

PATENT NO. : 5,624,776

DATED : April 29, 1997

INVENTORS : TETSUYA TAKEI ET AL.

It is certified that error appears in the above-identified patent and that said Letters Patent is hereby corrected as shown below:

COLUMN 14

Line 13, "was" (second occurrence) should be deleted;
Line 40, "patter" should read --pattern--.

COLUMN 16

Line 44, "indicated" should read --indicates--;
Line 62, "establish" should read --establishes--.

COLUMN 17

Line 10, "Generated" should read --generated--;
Line 31, "Generation" should read --generation--;
Line 47, "region-containing" should read --region containing--.

COLUMN 18

Line 2, "300/cm$^2$" should read --300/cm$^2$,--;
Line 39, "nucleuses-and" should read --nucleuses and--;
Line 45, "where" should read --of--.

COLUMN 20

Line 35, "lest" should read --least--;
Line 42, "(SIN)," should read --(SiN),-- and "(SIC)," should read --(SiC),--;

UNITED STATES PATENT AND TRADEMARK OFFICE

CERTIFICATE OF CORRECTION

PATENT NO. : 5,624,776

DATED : April 29, 1997

INVENTORS : TETSUYA TAKEI ET AL.

It is certified that error appears in the above-identified patent and that said Letters Patent is hereby corrected as shown below:

COLUMN 20 continued

Line 67, "medium.-In" should read --medium. In--.

COLUMN 21

Line 26, "(SIC)," should read --(SiC),--;
Line 48, "a" should read --as--;
Line 67, "composed" should read --composed of--.

COLUMN 22

Line 2, "that" should read --that it--;
Line 17, "(SIC)," should read --(SiC),--;
Line 19, "a" should be deleted;
Line 21, "a" should read --an--. first occurrence

COLUMN 23

Line 19, "Si-power" should read --Si-powder--;
Line 31, "while spots" should read --white spots--.

COLUMN 24

Line 5, "was conducted" should be deleted.

UNITED STATES PATENT AND TRADEMARK OFFICE

CERTIFICATE OF CORRECTION

PATENT NO. : 5,624,776

DATED : April 29, 1997

INVENTORS : TETSUYA TAKEI ET AL.

It is certified that error appears in the above-identified patent and that said Letters Patent is hereby corrected as shown below:

COLUMN 25

Line 24, "0f" should read --Of--.

COLUMN 26

Line 5, "were" should be deleted.

COLUMN 27

Line 17, "Si" should read --Si- --;
Line 59, "obtained" should read --obtain--;
Line 66, "shaft" (first occurrence) should read --shaft,--.

COLUMN 28

Line 11, "loosed" should read --loosened--;
Line 44, "ness;" should read --ness,--; "resolution;" should read --resolution,--; and "pattern;" should read --pattern,--;
Line 45, "coarseness;" should read --coarseness,-- and "appearance " " should read --appearance,--.

UNITED STATES PATENT AND TRADEMARK OFFICE

CERTIFICATE OF CORRECTION

PATENT NO. : 5,624,776

DATED : April 29, 1997

INVENTORS : TETSUYA TAKEI ET AL.

It is certified that error appears in the above-identified patent and that said Letters Patent is hereby corrected as shown below:

COLUMN 28 continued

Line 46, "reproducibility; durability;" should read --reproducibility, durability,--.

COLUMN 33

Line 38, "material" should read --material as--.

Signed and Sealed this

Eighteenth Day of November 1997

*Attest:*

Bruce Lehman

BRUCE LEHMAN

*Attesting Officer*

*Commissioner of Patents and Trademarks*